US012747601B2

(12) United States Patent
Wang et al.

(10) Patent No.: US 12,747,601 B2
(45) Date of Patent: Sep. 29, 2026

(54) POOL ROBOT AND AUTOMATIC UNDERWATER SPREADING METHOD

(71) Applicant: XINGMAI INNOVATION TECHNOLOGY (SUZHOU) CO., LTD., Suzhou (CN)

(72) Inventors: Shengle Wang, Suzhou (CN); Shilei Zhang, Suzhou (CN)

(73) Assignee: XINGMAI INNOVATION TECHNOLOGY (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 19/366,504

(22) Filed: Oct. 22, 2025

(65) Prior Publication Data

US 2026/0043260 A1 Feb. 12, 2026

Related U.S. Application Data

(63) Continuation of application No. PCT/CN2024/076014, filed on Feb. 5, 2024.

(30) Foreign Application Priority Data

Apr. 27, 2023 (WO) ..... PCT/CN2023/091115
Dec. 19, 2023 (CN) ..... 202323471851.8

(51) Int. Cl.
*E04H 4/12* (2006.01)
*C02F 1/00* (2023.01)
*E04H 4/16* (2006.01)

(52) U.S. Cl.
CPC ..... *E04H 4/1281* (2013.01); *E04H 4/1209* (2013.01); *E04H 4/1654* (2013.01)

(58) Field of Classification Search
CPC ... E04H 4/1654; E04H 4/1281; E04H 4/1209; C02F 2103/42; C02F 2103/007;
(Continued)

(56) References Cited

U.S. PATENT DOCUMENTS

2008/0237103 A1* 10/2008 King ..... E04H 4/1654 210/764
2009/0282627 A1* 11/2009 Porat ..... G06Q 20/3255 204/229.4
2019/0360226 A1* 11/2019 Schloss ..... E04H 4/1654

FOREIGN PATENT DOCUMENTS

CN 209053474 U 7/2019
CN 116940532 A 10/2023

OTHER PUBLICATIONS

International Search Report and Written Opinion for PCT/CN2024/076014.

(Continued)

*Primary Examiner* — Pranav N Patel
(74) *Attorney, Agent, or Firm* — Soleado Law, PC

(57) ABSTRACT

This application provides a pool robot and an automatic underwater spreading method. The pool robot includes a body, a storage module configured to store a to-be-spread reagent, where the storage module is disposed on the body, and a first opening is disposed on the storage module a drive module disposed on the body, connected to the storage module, and configured to drive and control the reagent in the storage module to be spread through the first opening, a moving module disposed on the body and configured to drive the pool robot to move in water along a motion path, and a control module disposed on the body connected to the moving module via signals, and configured to control the moving module to move.

17 Claims, 9 Drawing Sheets

(58) Field of Classification Search
CPC .. C02F 1/4674; C02F 1/50; C02F 1/76; C02F 2303/04
See application file for complete search history.

(56) References Cited

OTHER PUBLICATIONS

International Preliminary Report on Patentability Chapter I for PCT/CN2024/076014.
International Search Report and Written Opinion for PCT/CN2023/091115.
International Preliminary Report on Patentability Chapter I for PCT/CN2023/091115.

* cited by examiner

POOL ROBOT AND AUTOMATIC UNDERWATER SPREADING METHOD

CROSS REFERENCE TO RELATED APPLICATIONS

This application is a continuation of International Patent Application No. PCT/CN2024/076014, filed with the World Intellectual Property Organization on Feb. 5, 2024, which claims priority to: International Patent Application No. PCT/CN2023/091115, filed with the World Intellectual Property Organization on Apr. 27, 2023 and entitled "POOL ROBOT", and Chinese Patent Application No. 202323471851.8, filed with the China National Intellectual Property Administration on Dec. 19, 2023 and entitled "POOL ROBOT", which are hereby incorporated by reference herein.

TECHNICAL FIELD

The present disclosure relates to a water cleaning field, and in particular, to a pool robot and an automatic underwater spreading method.

BACKGROUND

A pool is a place for people to swim and relax, and poor water quality of the pool causes the pool to be unhygienic, which easily causes harm to health of a user. Currently, a main manner for maintaining the water quality of the pool is to manually spread a chemical agent into water in the pool to implement disinfection, clarification and algae removal by using the chemical agent. However, before the agent is manually spread, the agent first needs to be prepared based on an amount of water in the pool, and then the agent is manually spread onto a water surface of each region of the pool, leading to complex water quality maintenance operations, a long cleaning period, and high costs.

SUMMARY

The present disclosure provides a pool robot. The pool robot includes: a body; a storage module configured to store a to-be-spread reagent, where the storage module is disposed on the body, and a first opening is disposed on the storage module; a drive module disposed on the body, connected to the storage module, and configured to drive and control the reagent in the storage module to be spread through the first opening; a moving module disposed on the body and configured to drive the pool robot to move in water along a motion path; and a control module disposed on the body, connected to the moving module via signals, and configured to control the moving module to move.

The present disclosure provides an automatic underwater spreading method. The automatic underwater spreading method includes: obtaining a target region in a target water body and a target task corresponding to the target region, where the target task includes a spreading task for the target region; determining a first operating parameter of a drive module, a second operating parameter of a moving module, and a type and a dose of a to-be-spread reagent based on the target region and the target task; and controlling, based on the first operating parameter, the second operating parameter, and the type and the dose of the to-be-spread reagent, a pool robot to complete the target task.

The obtaining a target region and a target task corresponding to the target region includes: selecting a water region and detecting water quality of the water region to obtain water quality data corresponding to the water region. In a case where the water quality data exceeds a preset threshold, it indicates that the water region is the target region, and the corresponding target task is obtained based on the water quality data.

The water quality data includes at least one of a pH value, a total quantity of bacteria, free residual chlorine, urea, turbidity, a total quantity of solids, or salinity. That the water quality data exceeds a preset threshold includes: in a case where the water quality data includes at least two of the pH value, the total quantity of bacteria, free residual chlorine, urea, the turbidity, the total quantity of solids, or the salinity, when at least any one of the at least two items exceeds the preset threshold, it is considered that the water quality data exceeds the preset threshold.

The selecting a water region and detecting water quality of the water region to obtain water quality data corresponding to the water region includes: obtaining coordinates of the water region and a requirement of detecting the water quality of the water region; controlling, based on the coordinates, the moving module to drive the pool robot to reach the water region; and drawing external liquid in the water region, enabling the external liquid to flow to a detection part to obtain the water quality data by using the detection part.

The method further includes cleaning the detection part when the detection part completes detection.

The present disclosure provides an automatic underwater spreading assembly. The automatic underwater spreading assembly is configured to spread a reagent in water. The automatic underwater spreading assembly includes: a storage module configured to store a to-be-spread reagent; a drive module connected to the storage module and configured to drive the to-be-spread reagent to leave the storage module; a reagent outlet configured to allow the to-be-spread reagent to leave the storage module and then enter the water; and a control module connected to the drive module and a moving module via signals and configured to control the drive module.

The storage module includes a storage cavity, and openings are disposed on the storage cavity. The openings include a second opening and a first opening. The second opening is configured to allow fluid to enter the storage cavity. The first opening is configured to allow fluid to leave the storage cavity.

A first one-way valve is disposed in the second opening. The first one-way valve is configured to allow the fluid to unidirectionally flow in a direction in which the fluid enters the storage cavity.

A sealing cover detachably covers an end of the second opening, and the end is away from the storage cavity.

The automatic underwater spreading assembly further includes a body. The storage cavity is disposed in the body. A liquid adding opening is disposed on the body and communicates with the second opening.

A liquid inlet pump is disposed at the second opening. The liquid inlet pump is configured to drive liquid to enter the storage cavity. The to-be-spread reagent cannot leave the storage cavity before being mixed with the liquid. When a flow rate at which the liquid enters the storage cavity changes, a speed at which the to-be-spread reagent is mixed with the liquid changes.

The storage module includes a storage cavity. An opening is disposed on the storage cavity. The opening is configured to allow the to-be-spread reagent to enter and leave the storage cavity. A first one-way valve is detachably disposed in the opening. The first one-way valve is configured to allow fluid to unidirectionally flow in a direction in which the fluid enters the storage cavity.

The storage module includes a storage cavity. The storage cavity includes a flexible storage cavity and/or a rigid storage cavity.

The flexible storage cavity includes a flexible storage bag. The to-be-spread reagent is stored in the flexible storage bag.

The storage cavity includes a flexible storage cavity and a rigid storage cavity. The flexible storage cavity is disposed in the rigid storage cavity.

Openings are disposed on the storage cavity. The openings include an avoidance opening and a connection opening. The avoidance opening is disposed on the rigid storage cavity. The connection opening is disposed on the flexible storage cavity. The connection opening passes through the avoidance opening and extends to an outer surface of the rigid storage cavity. A first one-way valve is disposed in the connection opening. The first one-way valve is configured to allow the to-be-spread reagent to unidirectionally flow.

The connection opening includes a rigid connection portion. Rigidness of the rigid connection portion is greater than that of the flexible storage cavity. The rigid connection portion passes through the avoidance opening. A peripheral surface of the rigid connection portion is attached to an inner wall of the avoidance opening.

The automatic underwater spreading assembly further includes a body. The storage module is detachably disposed in the body.

The automatic underwater spreading assembly further includes a sealing structure. The body includes a liquid inlet portion. The reagent outlet is disposed on the body. The storage module includes a storage cavity and a second one-way valve communicating with the storage cavity. The storage module is disposed on the body. At least a part of the second one-way valve extends into the liquid inlet portion. The second one-way valve is configured to allow the to-be-spread reagent to unidirectionally flow, enabling some to-be-spread reagents in the storage cavity to flow into the liquid inlet portion. At least a part of the sealing structure is disposed in the liquid inlet portion to seal a joint between the second one-way valve and the liquid inlet portion.

The sealing structure includes a through hole configured to allow the second one-way valve to pass through. The through hole communicates with the liquid inlet portion. The automatic underwater spreading module further includes a blocking structure. At least a part of the blocking structure is movably disposed in the liquid inlet portion. The blocking structure is configured to block the through hole and has a blocking state and an open state. When the storage module is detached from the body of the automatic underwater spreading module, the blocking structure is switched to the blocking state to block the through hole. When the storage module is assembled on the body of the automatic underwater spreading module, the blocking structure is switched to the open state to avoid at least a part of the through hole, enabling the second one-way valve to communicate with the liquid inlet portion.

When the blocking structure is switched to the blocking state, the blocking structure moves toward the sealing structure. When the blocking structure is switched to the open state, the second one-way valve pushes the blocking structure to move away from the sealing structure.

The liquid inlet portion is concave. The automatic underwater spreading module further includes an elastic structure. One end of the elastic structure is connected to the blocking structure, and the other end of the elastic structure is connected to a bottom wall of the liquid inlet portion. The elastic structure is configured to allow the blocking structure to be reset to the blocking state.

When the blocking structure is in the open state, there is a preset distance between the blocking structure and an end of the sealing structure, where the end is provided with the through hole, so that a flow gap is formed between at least a part of the blocking structure and the sealing structure. In this way, the second one-way valve communicates with the liquid inlet portion through the flow gap.

A stepped surface is disposed in the liquid inlet portion. The sealing structure includes a first sealing portion and a second sealing portion connected to each other. The second sealing portion is disposed on the stepped surface. The first sealing portion is located on a side of the second sealing portion, where the side is away from the stepped surface. The second sealing portion includes the through hole. An inner wall of the through hole is in an interference fit with an outer circumferential surface of the second one-way valve. The first sealing portion is configured to seal at least a part of the gap between the second one-way valve and the liquid inlet portion.

The first sealing portion is tubular. The second sealing portion includes an annular sealing portion and a conical sealing portion. The annular sealing portion is connected to the first sealing portion. The conical sealing portion is connected to the annular sealing portion. The conical sealing portion is disposed at an inner hole of the annular sealing portion and is located at a side of the annular sealing portion, where the side is away from the first sealing portion. An end of the conical sealing portion is away from the annular sealing portion, and the end is the through hole.

A diameter of the conical sealing portion gradually decreases in a direction from the blocking structure to the bottom wall of the liquid inlet portion. An outer circumferential surface of the conical sealing portion is a first conical mating surface. The blocking structure includes: a tubular body, where an end surface of the tubular body is close to the sealing structure, and a second conical mating surface is disposed on the end surface; a blocking plate, where an end of the tubular body is away from the sealing structure, the blocking plate is disposed on the end to block the through hole, and when the blocking structure is in the blocking state, the tubular body is sleeved on at least a part of the conical sealing portion, so that the first conical mating surface abuts against at least a part of the second conical mating surface; and/or a pushing post, where a plate surface of the blocking plate faces the sealing structure, the pushing post is disposed on the plate surface and configured to push a valve core of the second one-way valve, and the pushing post is coaxially disposed with the through hole.

The automatic underwater spreading module further includes a mounting structure disposed between the storage module and the sealing structure. The mounting structure includes a tubular mounting portion and a first connection plate disposed on the tubular mounting portion. At least a part of the tubular mounting portion is disposed in the liquid inlet portion. The tubular mounting portion includes a penetration hole configured to allow the second one-way valve to pass through. The first connection plate is configured to be connected to the storage module and/or the body of the automatic underwater spreading module.

The drive module includes a first drive pump configured to drive the to-be-spread reagent to leave the storage module. One end of the first drive pump communicates with an outlet of the storage module, and the other end communicates with the reagent outlet.

The first drive pump includes: a first drive pump body configured to provide a driving force for the to-be-spread reagent to leave the storage module; a first duct configured to allow the to-be-spread reagent to leave the storage module, where one end of the first duct is connected to the outlet of the storage module, and the other end is connected to the first drive pump body; and a second duct configured to guide the to-be-spread reagent to the reagent outlet, where one end of the second duct is connected to the first drive pump body, and the other end is connected to the reagent outlet.

The first drive pump has a first operating state and a second operating state. When the first drive pump is in the first operating state, the first drive pump generates a driving force in a direction from the storage module to the reagent outlet. When the first drive pump is in the second operating state, the first drive pump generates a driving force in a direction from the reagent outlet to the storage module.

The storage module includes a rigid storage cavity configured to store the to-be-spread reagent. An outlet of the rigid storage cavity is connected to one end of the first drive pump. The rigid storage cavity further includes a pressure adjustment member configured to adjust pressure in the rigid storage cavity.

The storage module includes a rigid storage cavity configured to store the to-be-spread reagent. The rigid storage cavity includes a pressure adjustment member configured to adjust pressure in the rigid storage cavity. The drive module includes a piston drive member configured to move in the rigid storage cavity to squeeze the to-be-spread reagent out of the rigid storage cavity.

The rigid storage cavity includes at least one bent portion.

The automatic underwater spreading assembly includes an adjustment assembly configured to adjust a flow rate at which the to-be-spread reagent leaves the storage module.

The adjustment assembly includes: a spreading duct communicating with an outlet of the storage cavity, and a flow rate adjustment part configured to change a flow rate of fluid in the spreading duct.

The flow rate adjustment part is capable of moving relative to the spreading duct between a first position and a second position. In a process in which the flow rate adjustment part moves from the first position to the second position, the flow rate adjustment part is in contact with and squeezes the spreading duct, enabling a cross-sectional area of the flow rate duct to be changed.

The drive module further includes a position-limiting groove disposed on a side of the spreading duct. A shortest distance from the position-limiting groove to an axis of the spreading duct gradually increases or decreases in an axial direction of the spreading duct. The flow rate adjustment part is slidably disposed in the position-limiting groove. The flow rate adjustment part slides between the first position and the second position along the position-limiting groove.

The automatic underwater spreading assembly further includes a moving module configured to drive the automatic underwater spreading assembly to move in water along a motion path. The control module is connected to the moving module via signals and configured to control the moving module.

The automatic underwater spreading assembly further includes: a liquid inlet configured to allow external liquid to enter the automatic underwater spreading assembly; a liquid outlet configured to allow liquid in the automatic underwater spreading assembly to leave the automatic underwater spreading assembly; a main water pump configured to drive the external liquid to enter a cleaning module of the automatic underwater spreading assembly through the liquid inlet and drive cleaned liquid in the cleaning module to be spread in the water through the liquid outlet; the cleaning module configured to clean liquid and/or a moving region of the automatic underwater spreading assembly.

One end of the drive module communicates with the outlet of the storage module, and the other end of the drive module communicates with the reagent outlet. The main water pump drives the cleaned liquid to flow through the reagent outlet and drives the to-be-spread reagent flowing out through the reagent outlet to be evenly mixed with the cleaned liquid and then spread in the water through the liquid outlet.

The liquid outlet is disposed on at least one of a top, a bottom, or a side portion of the body of the automatic underwater spreading assembly.

When the automatic underwater spreading assembly floats on a water surface and spreads the reagent, the automatic underwater spreading assembly includes at least one liquid inlet located under the water surface and a liquid outlet.

The moving module is further configured to adjust an operation mode of the automatic underwater spreading assembly. The operation modes include a water surface operation mode and an underwater operation mode.

The automatic underwater spreading assembly further includes a stirring module configured to stir the to-be-spread reagent leaving the storage module, enabling the to-be-spread reagent to be evenly mixed with liquid in space in which the to-be-spread reagent is located.

The drive module is configured to drive the to-be-spread reagent to leave the storage module. Driving modes of the drive module include a continuous driving mode and an intermittent driving mode. The continuous driving mode indicates that the drive module continuously drives the to-be-spread reagent to leave the storage module. The intermittent driving mode indicates that the drive module intermittently drives the to-be-spread reagent to leave the storage module.

The automatic underwater spreading assembly further includes a reagent dose detection module configured to detect an in-position state of the storage module and/or a quantity of to-be-spread reagents stored in the storage module.

The automatic underwater spreading assembly further includes a mode selection module configured to adjust a working mode of the automatic underwater spreading assembly. The working modes include a spreading mode and a cleaning mode.

The mode selection module includes a spreading selection unit configured to adjust a driving mode in the spreading mode. The driving modes in the spreading mode include the continuous driving mode and the intermittent driving mode.

The present disclosure provides a pool cleaning system, includes: a pool robot and a pool control assembly disposed in a pool. The automatic underwater spreading assembly is disposed on the pool robot and/or the pool control assembly. A water quality detection module is disposed on at least one of the pool robot or the pool control assembly and configured to obtain water quality data of each region of the pool. The water quality detection module is connected to a control module via signals.

The water quality detection module includes: a detection part configured to detect water quality; and a second drive pump communicating with the detection part. The second drive pump has a third operating state. When the second drive pump is in the third operating state, the second drive pump drives external liquid to flow through the detection part.

The water quality detection module includes: a first detection opening communicating with the detection part, where the first detection opening is configured to allow the external liquid to enter the water quality detection module; and a second detection opening communicating with the detection part, where the second detection opening is configured to allow the external liquid to leave the water quality detection module. When the second drive pump is in the third operating state, the second drive pump drives the liquid to flow from the first detection opening to the second detection opening.

The water quality detection module further includes a first flow channel. The first flow channel is configured to allow the detection part to communicate with the second detection opening. A third one-way valve is disposed in the first flow channel. The third one-way valve is configured to allow the liquid to unidirectionally flow in a direction in which the liquid leaves the detection part.

The water quality detection module includes a water purifier communicating with the detection part. The water purifier is configured to provide cleaned liquid. The second drive pump further has a fourth operating state. When the second drive pump is in the fourth operating state, the second drive pump drives the cleaned liquid to flow through the detection part.

The water quality detection module includes: a third detection opening configured to allow the liquid to enter the water quality detection module; a second flow channel configured to allow the third detection opening to communicate with the detection part, where the water purifier is disposed in the second flow channel, and the water purifier purifies the liquid to provide the cleaned liquid; and a fourth one-way valve disposed in the second flow channel, where the fourth one-way valve is configured to allow the liquid to unidirectionally flow in a direction in which the liquid enters the detection part. When the second drive pump is in the fourth operating state, the second drive pump drives the liquid to flow from the third detection opening to the first detection opening.

The pool control assembly includes a station. The station is disposed on a poolside or floats on a water surface of a pool. The pool control assembly and/or the water quality detection module are/is disposed on the station.

The pool control assembly includes a water circulation system. The water circulation system is configured to add liquid to the pool. The automatic underwater spreading assembly is disposed in the water circulation system. The water circulation system further includes a discharging opening. The liquid enters the pool through the discharging opening. The discharging opening communicates with a reagent outlet in an open-close manner. When the reagent outlet communicates with the discharging opening, the liquid is evenly mixed with a to-be-spread reagent.

BRIEF DESCRIPTION OF THE DRAWINGS

To illustrate the technical solutions in embodiments of the present disclosure more clearly, the following briefly introduces the accompanying drawings needed for describing the embodiments. It is clear that the accompanying drawings in the following descriptions are merely some embodiments of the present disclosure, and a person of ordinary skill in the art may further obtain other accompanying drawings from these accompanying drawings without creative efforts.

Figure 1:
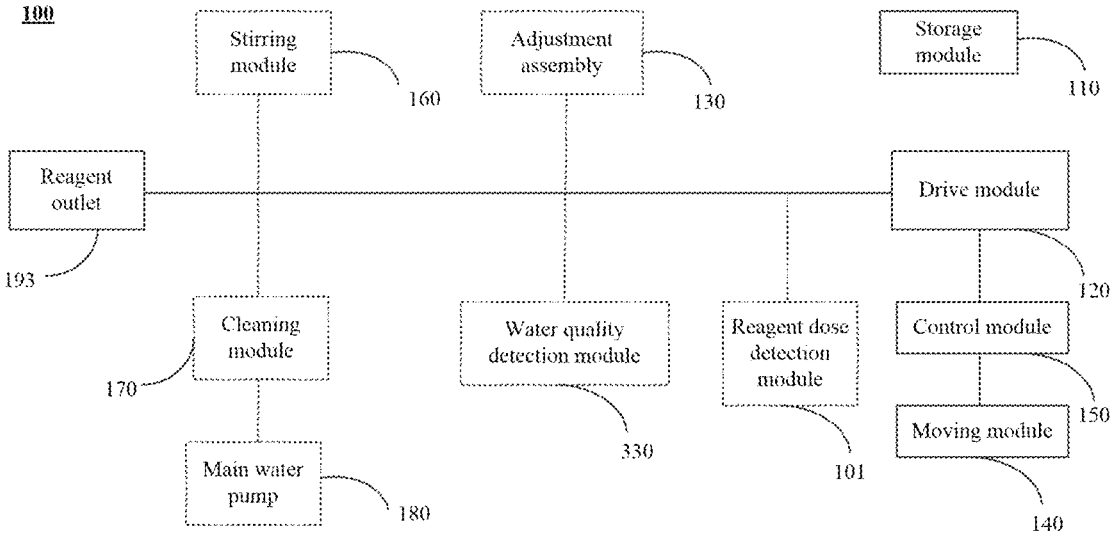
FIG. 1 is a schematic diagram of modules of a pool robot according to some embodiments of the present disclosure.

Reference numerals: 100: pool robot; 101: reagent dose detection module; 110: storage module; 111: rigid storage cavity outlet; 112-1: first bent portion; 112-2: second bent portion; 112-3: third bent portion; 112-4: fourth bent portion;

113: storage cavity; 114: opening; 114-1: first opening; 114-2: second opening; 115: first one-way valve; 116: sealing cover; 118: avoidance opening; 119: connection opening; 119-1: rigid connection portion; 120: drive module; 121: first drive pump; 121-1: first drive pump body; 121-2: first duct; 121-3: second duct; 130: adjustment assembly; 131: spreading duct; 132: flow rate adjustment part; 133: position-limiting groove; 140: moving module; 141: track; 142-1: first propeller; 142-2: second propeller; 150: control module; 160: stirring module; 170: cleaning module; 171: filtering box; 172: roller brush; 180: main water pump; 181: main water pump impeller; 182: main water pump body; 190: body; 191: liquid inlet; 191-1: first liquid inlet; 191-2: second liquid inlet; 191-3: third liquid inlet; 192: liquid outlet; 193: reagent outlet; 2101: liquid inlet portion; 2102: stepped surface; 2201: second one-way valve; 210: mounting structure; 211: tubular mounting portion; 2111: first tubular structure; 2112: plate structure; 212: penetration hole; 213: first connection plate; 220: sealing structure; 221: first sealing portion; 222: through hole; 223: annular sealing portion; 224: conical sealing portion; 2241: first conical mating surface; 230: blocking structure; 231: tubular body; 2311: second conical mating surface; 2312: second tubular structure; 2313: third tubular structure; 2314: second connection plate; 232: blocking plate; 233: pushing post; 234: limitation plate; 300: pool cleaning system; 310: pool control assembly; 311: station; 312: water circulation system; 3121: discharging opening; 320: automatic underwater spreading assembly; 330: water quality detection module; 331: detection part; 332: second drive pump; 333: detection cavity; 3331: first detection opening; 3332: second detection opening; 334: third drive pump; 335: third detection opening; 336: first flow channel; 337-1: third one-way valve; 337-2: fourth one-way valve; 338: water purifier; 339: second flow channel.

DETAILED DESCRIPTION

The following clearly and completely describes the technical solutions in embodiments of the present disclosure with reference to the accompanying drawings in embodiments of the present disclosure. It is clear that the described embodiments are merely some but not all of embodiments of the present disclosure. All other embodiments obtained by a person of ordinary skill in the art based on embodiments of the present disclosure without creative efforts shall fall within the protection scope of the present disclosure.

An "embodiment" mentioned in this specification indicates that a particular feature, structure, or characteristic described with reference to this embodiment may be included in at least one embodiment of the present disclosure. The phrase shown in various positions in this specification may not necessarily refer to a same embodiment, and is not an independent or optional embodiment exclusive from another embodiment. It is explicitly and implicitly understood by a person skilled in the art that embodiments described in this specification may be combined with another embodiment.

When water quality of a pool is manually maintained, a reagent first needs to be prepared based on an amount of water in the pool, and then the reagent is manually spread onto a water surface of the pool, leading to complex water quality maintenance operations, a long cleaning period, and high costs. According to the pool robot and the automatic underwater spreading method provided in some embodiments of the present disclosure, the reagent is automatically spread in water in the pool without manual operation. This facilitates and simplifies water quality maintenance, shortens a maintenance period of the pool, and reduces maintenance costs.

The following describes the pool robot 100 provided in the present disclosure in detail with reference to embodiments.

Figure 2:
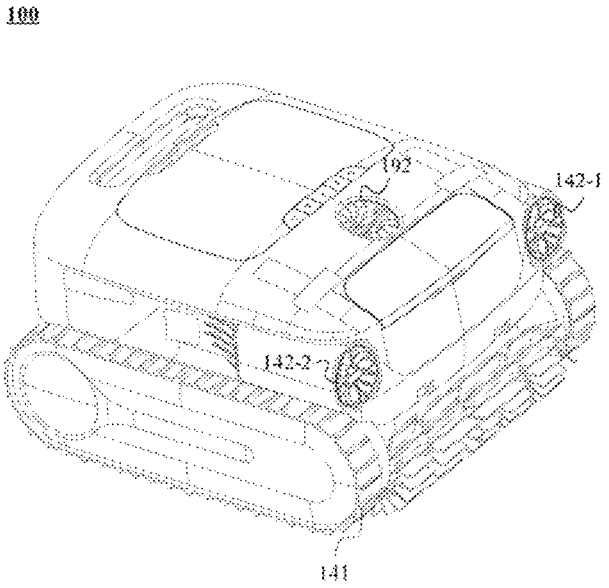
FIG. 2 is a first schematic structural diagram of a pool robot according to some embodiments of the present disclosure.

With reference to FIG. 1 to FIG. 3, the present disclosure provides a pool robot 100. The pool robot 100 is configured to perform cleaning, disinfecting, rescuing, and other tasks in a pool. The pool robot 100 includes a body 190, a storage module 110, a drive module 120, a moving module 140, and a control module 150. A first opening 114-1 is disposed on the storage module 110. The drive module 120 is disposed on the body 190 and connected to the storage module 110. The drive module 120 is configured to drive and control a reagent in the storage module 110 to be spread through the first opening 114-1. The moving module 140 is disposed on the body 190. The moving module 140 is configured to drive the pool robot 100 to move in water along a motion path. The control module 150 is disposed on the body 190 and connected to the moving module 140 via signals. The control module 150 is configured to control the moving module 140 to move.

The storage module 110 is configured to store a to-be-spread reagent. The storage module 110 is disposed on the body 190. The storage module 110 may be disposed in the body 190. The storage module 110 may alternatively be detachably mounted to the body 190. A first opening 114-1 is disposed on the storage module 110. The to-be-spread reagent may be a reagent required by the pool robot 100 to perform maintenance on the liquid, such as algae removal, clarification, and disinfection. The to-be-spread reagent may be solid or liquid. The to-be-spread reagent may include, but is not limited to, a clarifying agent, an algae removing agent, coagulant aids, disinfectant, a pH adjuster, and the like.

The drive module 120 is disposed on the body 190 and connected to the storage module 110. The drive module 120 is configured to drive and control a reagent in the storage module 110 to be spread through the first opening 114-1. The first opening 114-1 may be directly open to an external environment. The to-be-spread reagent may enter external liquid directly through the first opening 114-1. The first opening 114-1 may alternatively communicate with other structures, so that the to-be-spread reagent is indirectly spread in the external liquid through the other structures.

A manner in which the drive module 120 drives and controls the reagent in the storage module 110 to be spread through the first opening 114-1 is not limited herein. In a specific embodiment, the drive module 120 includes a push structure. The push structure is in contact with the to-be-spread reagent and may move relative to the storage module 110. When the push structure moves, the push structure pushes the to-be-spread reagent in the storage module 110 to leave the storage module 110. In another specific embodiment, the drive module 120 includes a suction structure. The suction structure is connected to an outlet of the storage module 110. The suction structure may suck liquid located at the outlet of the storage module 110 to change pressure at the outlet of the storage module 110. When the pressure at the outlet of the storage module 110 is reduced by using the suction structure, the to-be-spread reagent is driven by a suction force to leave the storage module 110.

The drive module 120 may control, based on a first operating parameter, the reagent in the storage module 110 to be spread through the first opening 114-1. The first operating parameter may be an operating parameter of the drive module 120. In some embodiments, the first operating parameter may include at least a speed at which the to-be-spread reagent leaves the storage module 110. For example, the first operating parameter may be a first water discharging speed, such as 0.25 mL/s, indicating that the drive module 120 drives 0.25 mL of the to-be-spread reagent to leave the storage module 110 per second.

In some embodiments, the first operating parameter may further include one or more of: a spreading time range, a drive interval, and drive duration. The spreading time range may be a time range in which the drive module 120 drives the to-be-spread reagent to leave the storage module 110. The drive interval may be an interval between two times of driving the to-be-spread reagent by the drive module 120 to leave the storage module 110. The drive duration may be duration in which the drive module 120 drives the to-be-spread reagent to leave the storage module 110. For example, the first operating parameter may further include the drive interval, such as 5 s, and the drive duration, such as 3 s. In other words, the drive module 120 may drive the to-be-spread reagent to leave the storage module 110 for 3 s, the drive module 120 takes a rest of 5 s, and then, the drive module 120 drives the to-be-spread reagent to leave the storage module 110 for 3 s, and the rest may be deduced by analogy. For another example, the first operating parameter may include the spreading time range, such as 13 s, and the drive duration, such as 5 s. In other words, within each spreading time range of 13 s, the drive module 120 may drive the to-be-spread reagent to leave the storage module 110 for 5 s. The drive duration of 5 s may be at any time range of the spreading time range. For example, the drive duration of 5 s may be the first 5 s or the last 5 s of the spreading time range.

The moving module 140 is disposed on the body 190. The moving module 140 is configured to drive the pool robot 100 to move in water along a motion path.

Figure 3A:
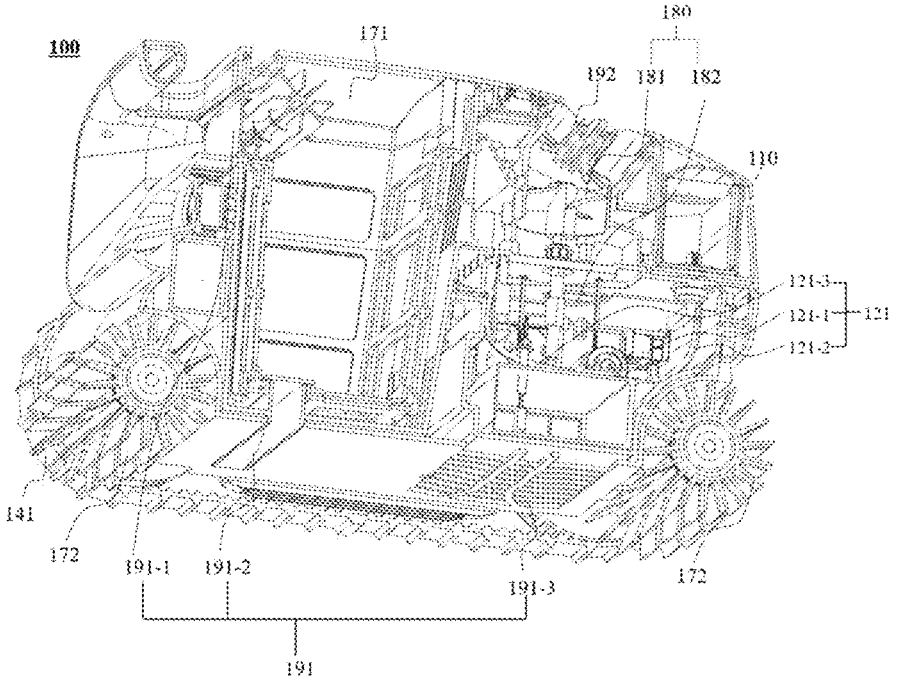
FIG. 3A is a schematic cross-sectional diagram of a pool robot according to some embodiments of the present disclosure.
Figure 3B:
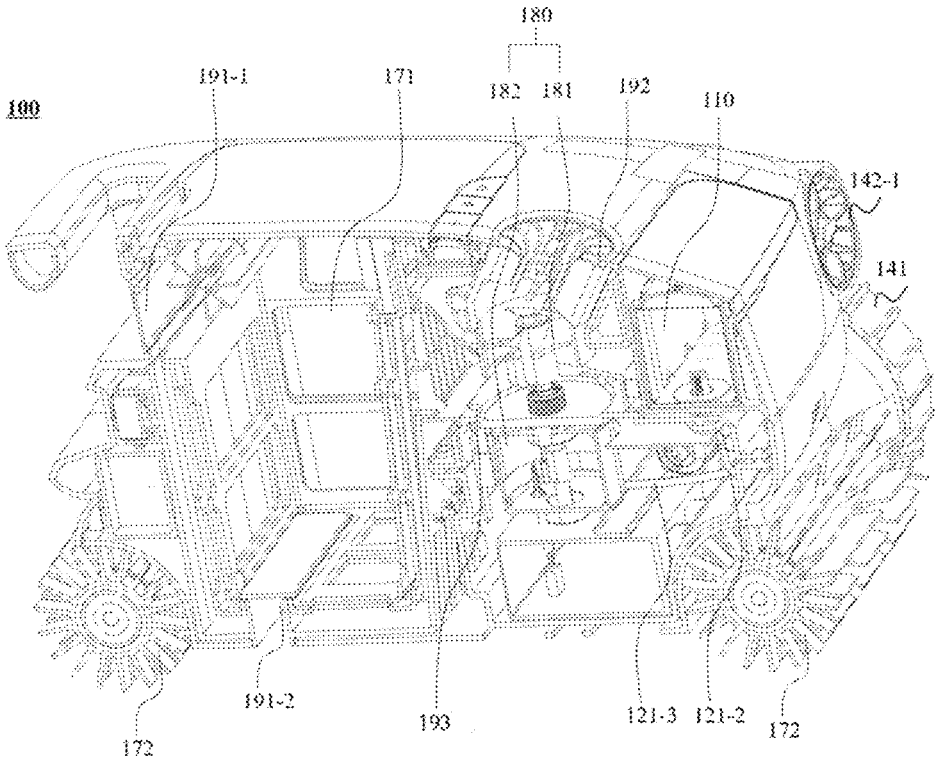
FIG. 3B is another schematic cross-sectional diagram of a pool robot according to some embodiments of the present disclosure.

The moving module 140 may include various components configured to drive the pool robot 100 to move. As shown in FIG. 3A and FIG. 3B, the moving module 140 may include a track 141. The pool robot 100 may move at the bottom of the pool by using the track 141. The moving module 140 may further include a first propeller 142-1 and a second propeller 142-2. The liquid may be discharged through the first propeller 142-1 and the second propeller 142-2, so that a driving force is generated to drive the pool robot 100 to move in the water under an action force in a direction opposite to a water discharging direction.

The motion path may be a path at which the pool robot 100 moves when performing maintenance for the water body, such as algae removal, clarification, and disinfection. The motion path may be, but is not limited to, a rectangular motion path, a random motion path, a Z-shaped motion path, a spiral motion path, a square spiral motion path, and the like. The motion path may be set by a user (for example, a pool maintainer) as required. For example, when the pool robot 100 disinfects a large water body, the user may set the motion path as the spiral motion path or the square spiral motion path. In other words, the pool robot 100 may move in the water body along the spiral motion path or the square spiral motion path and spread disinfectant. The pool robot 100 may move from an outer side to an inner side of the water body until the entire surface of the water body is covered. In some embodiments, the motion path may be determined in other manners. For example, the control module 150 may determine the motion path based on a parameter determining model.

Figure 10:
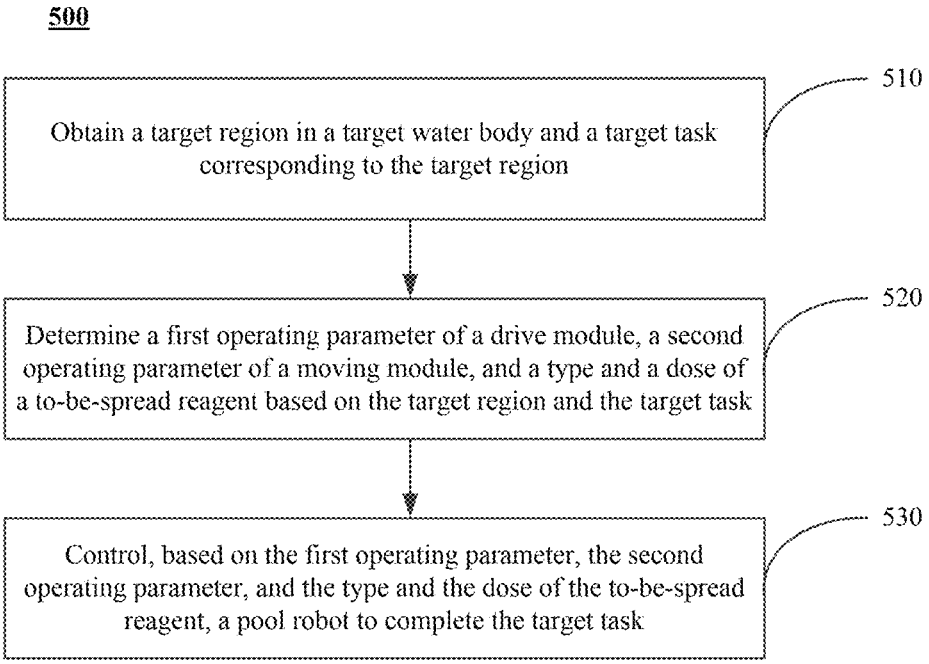
FIG. 10 is a schematic flow chart of an automatic underwater spreading method according to some embodiments of the present disclosure.
Figure 11:
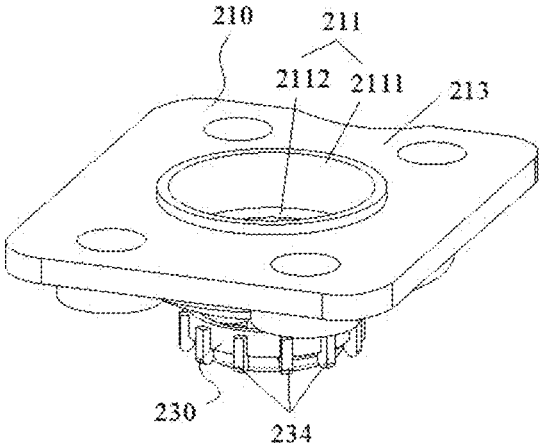
FIG. 11 is a schematic diagram of a three-dimensional structure existing when a sealing structure and a blocking structure are assembled according to some embodiments of the present disclosure.
Figure 12:
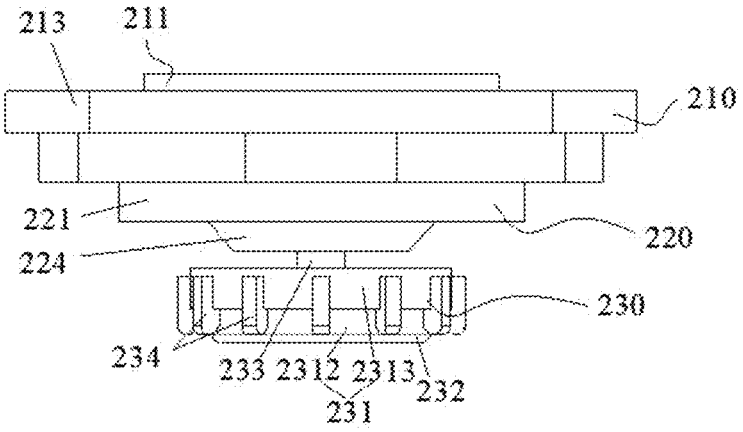
FIG. 12 is a front view existing when the sealing structure and the blocking structure in FIG. 11 are assembled.
Figure 13:
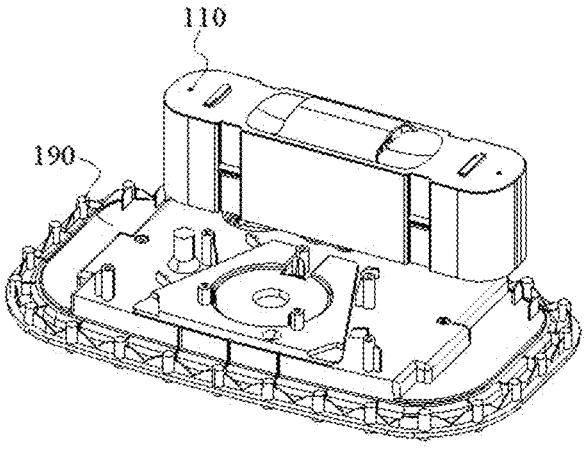
FIG. 13 is a schematic diagram of a partial three-dimensional structure existing when the sealing structure and the blocking structure in FIG. 11 are assembled on a body.

For details about determining the motion path based on the parameter determining model, refer to FIG. 10 and related descriptions thereof.

In some embodiments of the present disclosure, the motion path of the pool robot 100 in the water body can be quickly and accurately determined based on the parameter determining model, so that the reagent can be spread pertinently. This improves maintenance efficiency of the water body and reduces maintenance costs.

The control module 150 is disposed on the body 190 and connected to the moving module 140 via signals. The control module 150 is configured to control the moving module 140 to move. The control module 150 may control the moving module 140 based on a second operating parameter. The second operating parameter may be an operating parameter of the moving module 140. The second operating parameter may include a moving speed and a motion path of the moving module 140.

In some embodiments, the control module 150 may determine the first operating parameter and the second operating parameter in various methods. The first operating parameter and/or the second operating parameter may be a preset default parameter. When the first operating parameter or the second operating parameter is a preset default parameter, the control module 150 may adjust one of the first operating parameter or the second operating parameter that is not the default parameter, to control a quantity of to-be-spread reagents per unit volume (for example, per $m^3$) in the water. When both the first operating parameter and the second operating parameter are preset default parameters, a concentration of the to-be-spread reagent may be adjusted in advance to adjust the quantity of reagents.

In some embodiments, the control module 150 may alternatively perform modeling or use various data analysis algorithms, such as regression analysis and discriminant analysis, to determine the first operating parameter and the second operating parameter. The control module 150 may determine the first operating parameter of the drive module 120 and/or the second operating parameter of the moving module 140 based on a target task. For details about the above embodiment, refer to FIG. 10 and related descriptions thereof.

Specifically, a working mode of the pool robot 100 may be that the control module 150 controls the moving module 140 to drive the pool robot 100 to move in the water and simultaneously controls the drive module 120 to operate. The to-be-spread reagent in the storage module 110 is driven by the drive module 120 to be spread in the water, so that the to-be-spread reagent is evenly spread.

In some embodiments of the present disclosure, the pool robot 100 is used to maintain the water body, so that the reagent is spread in the water automatically instead of being manually spread. In addition, it is ensured that the reagent is fully and evenly mixed with the water without any circulation system (such as a swimming pool circulation system). This can shorten a maintenance period of the water body and reduce maintenance costs.

In some embodiments, the storage module 110 includes a storage cavity 113. A second opening 114-2 is disposed on the storage cavity 113. The second opening 114-2 is configured to allow fluid to enter the storage cavity 113. The fluid may be the to-be-spread reagent or the external liquid.

Based on the above disposition, when the to-be-spread reagent in the storage cavity 113 is insufficient, a user may replenish the to-be-spread reagent into the storage cavity 113 through the second opening 114-2, which is convenient to operate.

In some embodiments, a first one-way valve 115 is disposed in the second opening 114-2. The first one-way valve 115 is configured to allow the fluid to unidirectionally flow in a direction in which the fluid enters the storage cavity 113. Alternatively, the storage cavity 113 includes a sealing cover 116 detachably covering the second opening 114-2. Alternatively, a first one-way valve 115 is disposed in the second opening 114-2. A sealing cover 116 is detachably disposed at the second opening 114-2. The sealing cover 116 covers the first one-way valve 115.

Specifically, when the sealing cover 116 covers the second opening 114-2, the second opening 114-2 is closed, and the external liquid cannot enter the second opening 114-2. When the sealing cover 116 is detached from the second opening 114-2, the second opening 114-2 is opened, and the external liquid can enter the storage cavity 113 through the second opening 114-2. The first one-way valve 115 may be a known one-way valve, provided that the fluid can unidirectionally flow. Details are not described herein.

Based on the above disposition, the first one-way valve 115 is disposed, so that the to-be-spread reagent does not easily leak out of the storage module 110 through the second opening 114-2, leading to good sealing performance of the storage cavity 113. The sealing cover 116 reduces a probability that external debris enters the storage cavity 113, so that the to-be-spread reagent cannot be easily contaminated, leading to a good cleaning effect of the pool robot 100.

In some embodiments, a liquid adding opening and a reagent outlet 193 are disposed on the body 190. The liquid adding opening communicates with the second opening 114-2. The first opening 114-1 communicates with the reagent outlet 193. The reagent spread through the first opening 114-1 enters the water through the reagent outlet 193.

The reagent outlet 193 may serve as an outlet for the to-be-spread reagent to leave the storage module 110 and then enter the liquid. The pool robot 100 may include one or more reagent outlets 193. As shown in FIG. 3B, the reagent outlet 193 may be disposed inside the pool robot 100. After the to-be-spread reagent flows out through the reagent outlet 193, the to-be-spread reagent may be mixed with another liquid (such as cleaned liquid) in space in which the reagent is located, and then flow out through a liquid outlet 192. For details about the cleaned liquid and the liquid outlet 192, refer to the following description. In some embodiments, the reagent outlet 193 may alternatively be disposed on at least one of a top, a bottom, or a side portion of the body 190 of the pool robot 100, so that the to-be-spread reagent can enter the water directly through the reagent outlet 193 to complete spreading. In some embodiments, when the pool robot 100 floats on the water surface and spreads the reagent, the pool robot 100 may include at least one reagent outlet 193 located under the water surface or located close to the water to ensure that the to-be-spread reagent can enter the water. For example, when the pool robot 100 floats on the water surface and spreads the reagent, the reagent outlet 193 may be disposed on a side portion, of the body 190 of the pool robot 100, located under the water surface or on the bottom of the body 190 of the pool robot 100.

Based on the above disposition, the user may add the to-be-spread reagent to the storage cavity 113 through the liquid adding opening instead of directly through the second opening 114-2. A position at which the storage cavity 113 is mounted may not be limited to a position close to a surface of the pool robot 100, leading to a more flexible structural design. In addition, the liquid adding opening may be disposed at a position that is easier for the user to operate, leading to convenient operation.

In some embodiments, a solid reagent is stored in the storage module 110. The drive module 120 includes a liquid inlet pump communicating with the second opening 114-2 and a control valve configured to control operation of the liquid inlet pump. The liquid inlet pump is configured to drive external liquid to enter the storage cavity 113. The liquid inlet pump may be a peristaltic pump or any other pump that can implement the above function. The control valve is configured to control the liquid inlet pump to be turned on and turned off, a speed at which liquid flows into the liquid inlet pump, and an amount of liquid flowing into the liquid inlet pump, to control a mixing speed and a mixing dose of the to-be-spread reagent and the external liquid.

Specifically, the solid reagent may be solid. The solid reagent is mixed with the liquid and then discharged from the storage cavity 113. The solid reagent is gradually dissolved in the external liquid to form to-be-spread liquid. When a flow rate at which the liquid enters the storage cavity 113 changes, a speed at which the solid reagent is mixed with the external liquid changes. For example, when a flow rate at which the external liquid enters the storage cavity 113 increases, a speed at which the solid reagent is mixed with the liquid increases. In this case, a speed at which the to-be-spread reagent leaves the storage cavity 113 increases.

Based on the above disposition, the storage module 110 controls the speed at which the to-be-spread reagent leaves the storage cavity 113 by controlling an operating state of the liquid inlet pump. This facilitates simple control and convenient use.

In some other embodiments, the storage module 110 includes a storage cavity 113. An opening 114 is disposed on the storage cavity 113. The opening 114 is configured to allow the to-be-spread reagent to enter and leave the storage cavity 113. A first one-way valve 115 is detachably disposed in the opening 114. The first one-way valve 115 is configured to allow fluid to unidirectionally flow in a direction in which the fluid enters the storage cavity 113. The fluid may be the to-be-spread reagent. When the first one-way valve 115 is disposed in the opening 114, the fluid can only enter the storage cavity 113. When the first one-way valve 115 is detached from the opening 114, the fluid can enter or leave the storage cavity 113.

Based on the above disposition, the user may control the to-be-spread reagent to enter or leave the storage cavity 113 by mounting or detaching the first one-way valve 115. Only one opening 114 needs to be disposed on the storage cavity 113, leading to a simple structure.

In some embodiments, the drive module 120 includes an adjustment assembly 130. The adjustment assembly 130 includes a spreading duct 131 and a flow rate adjustment part 132. The spreading duct 131 communicates with the first opening 114-1 of the storage module 110. The to-be-spread reagent is spread in the external liquid through the spreading duct 131. The flow rate adjustment part 132 is configured to change a flow rate of fluid in the spreading duct 131. In this way, when spreading the to-be-spread reagent, the pool robot 100 can precisely control a dose of the spread reagent. This facilitates convenient use and helps reduce a quantity of to-be-spread reagents and reduce costs.

A specific manner in which the flow rate adjustment part 132 changes the flow rate in the spreading duct 131 may be changing a cross-sectional area of the spreading duct 131 or a size of an outlet of the storage cavity 113. This is not limited herein.

In a specific embodiment, the flow rate adjustment part 132 covers the outlet of the storage cavity 113. The flow rate adjustment part 132 may move relative to the storage cavity 113 to change an opening area of the outlet of the storage cavity 113.

In another specific embodiment, the flow rate adjustment part 132 may move relative to the spreading duct 131 between a first position and a second position. In a process in which the flow rate adjustment part 132 moves from the first position to the second position, the flow rate adjustment part 132 is in contact with and squeezes the spreading duct 131, enabling the cross-sectional area of the flow rate duct to be changed. In this way, the flow rate adjustment part 132 can squeeze the spreading duct 131 to change the flow rate in the spreading duct 131, leading to a simple structure.

In some embodiments, the drive module 120 further includes a position-limiting groove 133. The position-limiting groove 133 is disposed on a side of the spreading duct 131. A shortest distance from the position-limiting groove 133 to an axis of the spreading duct 131 gradually increases or decreases in an axial direction of the spreading duct 131. In other words, the position-limiting groove 133 tilts relative to the axis of the spreading duct 131. The flow rate adjustment part 132 is slidably disposed in the position-limiting groove 133. The flow rate adjustment part 132 slides between the first position and the second position along the position-limiting groove 133. Based on the above disposition, the flow rate adjustment part 132 can slide along the position-limiting groove 133, and the position-limiting groove 133 may guide movement of the flow rate adjustment part 132. In this way, the flow rate adjustment part 132 can precisely move to the first position or the second position, and the drive module 120 can adjust the flow rate of the to-be-spread reagent more precisely.

The movement of the flow rate adjustment part 132 may be controlled by the control module 150 or manually controlled. A shape of the flow rate adjustment part 132 may be determined based on an actual situation, provided that the flow rate adjustment part 132 can squeeze the spreading duct 131. This is not limited herein. In a specific embodiment, the flow rate adjustment part 132 includes a squeezing portion in a round-disc shape and a rotation shaft disposed on a side of the squeezing portion. The rotation shaft is slidably embedded in the position-limiting groove 133. A periphery of the squeezing portion squeezes the spreading duct 131.

In some embodiments, the drive module 120 includes a first drive pump 121. The first drive pump 121 is configured to drive the to-be-spread reagent to leave the storage module 110. The first drive pump 121 may be a peristaltic pump or any other pump (such as a syringe pump) that can implement the function. One end of the first drive pump 121 communicates with the outlet of the storage module 110. The other end of the first drive pump 121 communicates with the reagent outlet 193. One end of the first drive pump 121 directly communicates with the reagent outlet 193 or communicates with the reagent outlet 193 through other components of the pool robot 100.

In some embodiments, as shown in FIG. 3A and FIG. 3B, the first drive pump 121 may include a first drive pump body 121-1, a first duct 121-2, and a second duct 121-3. The first drive pump body 121-1 may be configured to provide a driving force for the to-be-spread reagent to leave the storage module 110. The first duct 121-2 may be configured as a channel for the to-be-spread reagent to leave the storage module 110. One end of the first duct 121-2 communicates with the outlet of the storage module 110, and the other end of the first duct 121-2 is connected to the first drive pump body 121-1. The second duct 121-3 may be configured to guide the to-be-spread reagent to the reagent outlet 193. One end of the second duct 121-3 is connected to the first drive pump body 121-1, and the other end of the second duct 121-3 communicates with the reagent outlet 193. In this way, the to-be-spread reagent is driven by the first drive pump body 121-1 to leave through the outlet of the storage module 110 and flow out of the reagent outlet 193 through the first duct 121-2 and the second duct 121-3.

In some embodiments of the present disclosure, the first drive pump 121 drives the to-be-spread reagent to leave the storage module 110 and be spread in the water, so that the pool robot 100 can evenly and comprehensively spread the reagent with high spreading efficiency.

The first drive pump 121 has a first operating state and a second operating state. When the first drive pump 121 is in the first operating state, the first drive pump 121 generates a driving force in a direction from the storage module 110 to the reagent outlet 193, and the first drive pump 121 drives the to-be-spread reagent to leave the storage module 110. When the first drive pump 121 is in the second operating state, the first drive pump 121 generates a driving force in a direction from the reagent outlet 193 to the storage module 110, and the first drive pump 121 drives residual liquid between the reagent outlet 193 and the storage module 110 to move to the storage module 110, so that a flow channel between the reagent outlet 193 and the storage module 110 is unobstructed. In this way, when the first drive pump 121 is in the first operating state, the first drive pump 121 drives the to-be-spread reagent to leave the storage module 110, and the first drive pump 121 is switched to the second operating state after the reagent has been spread, enabling the residual liquid between the reagent outlet 193 and the storage module 110 to be pumped out and discharged. In this way, the flow channel between the reagent outlet 193 and the storage module 110 is not easily blocked.

In some embodiments, the pool robot 100 further includes a reagent dose detection module 101. The reagent dose detection module 101 is configured to detect an in-position state of the storage module 110 and/or a quantity of to-be-spread reagents stored in the storage module 110.

Specifically, the in-position state of the storage module 110 is a state indicating whether the storage module 110 is mounted on the pool robot 100. When the storage module 110 is mounted on the pool robot 100, the storage module 110 is in the in-position state. When the storage module 110 is not mounted on the pool robot 100, the storage module 110 is not in the in-position state. The reagent dose detection module 101 may be configured to detect only the in-position state of the storage module 110. The reagent dose detection module 101 may alternatively be configured to detect only the quantity of to-be-spread reagents stored in the storage module 110. The reagent dose detection module 101 may alternatively be configured to detect both the in-position state of the storage module 110 and the quantity of to-be-spread reagents stored in the storage module 110.

Based on the above disposition, the pool robot 100 detects in time, by using the reagent dose detection module 101, whether the quantity of to-be-spread reagents meets a spreading requirement, so that the user can replenish the to-be-spread reagent in time, and the pool robot 100 is used conveniently.

Figure 9:
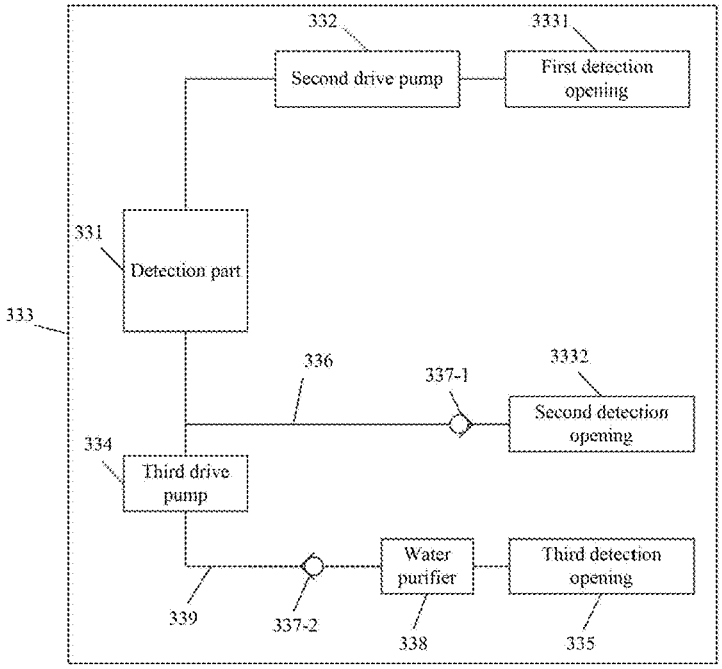
FIG. 9 is a schematic structural diagram of a detection module according to some embodiments of the present disclosure.

In some embodiments, with reference to FIG. 9, the pool robot 100 further includes a water quality detection module 330. The water quality detection module 330 is configured to obtain water quality data of each region of the pool. The water quality data may include a pH value, turbidity, a quantity of total solids, salinity, and the like of the water in the pool. The water quality detection module 330 is connected to the control module 150 via signals. The drive module 120 controls, based on detection data of the water quality detection module 330, the reagent in the storage module 110 to be spread.

Based on the above disposition, the pool robot 100 detects water quality by using the water quality detection module 330 and performs cleaning, so that the water quality of the pool can be well monitored and maintained in a better state without manually spreading the reagent. This facilitates and simplifies water quality maintenance, shortens a maintenance period of the pool, and reduces maintenance costs.

In some embodiments, the water quality detection module 330 includes a detection part 331 and a second drive pump 332. The detection part 331 is configured to detect the water quality. The detection part 331 may include a water quality sensor or the like. The second drive pump 332 communicates with the detection part 331. The second drive pump 332 has a third operating state. When the second drive pump 332 is in the third operating state, the second drive pump 332 drives the external liquid to flow through the detection part 331. When the external liquid flows through the detection part 331, the detection part 331 may obtain water quality data of the external liquid.

Based on the above disposition, the second drive pump 332 can actively drive the external liquid to reach the detection part 331, so that the following case can be avoided: The detection part 331 cannot be in contact with the external liquid, causing the water quality detection module 330 to fail to detect the water quality. This leads to stable performance.

In some embodiments, the water quality detection module 330 further includes a detection cavity 333. The detection part 331 is disposed in the detection cavity 333. A first detection opening 3331 and a second detection opening 3332 are disposed on the detection cavity 333.

The first detection opening 3331 communicates with the detection part 331. The first detection opening 3331 is configured to allow the external liquid to enter the water quality detection module 330. The second detection opening 3332 communicates with the detection part 331. The second detection opening 3332 is configured to allow the external liquid to leave the water quality detection module 330. The second drive pump 332 is connected to the first detection opening 3331. The first detection opening 3331 and the second detection opening 3332 respectively communicate with two opposite sides of the detection part 331. When the second drive pump 332 is in the third operating state, the second drive pump 332 drives the external liquid to flow sequentially from the first detection opening 3331 to the detection part 331 and the second detection opening 3332.

In some embodiments, the water quality detection module 330 further includes a first flow channel 336. The first flow channel 336 is configured to allow the detection part 331 to communicate with the second detection opening 3332. A third one-way valve 337-1 is disposed in the first flow channel 336. The third one-way valve 337-1 is configured to allow the liquid to unidirectionally flow in a direction in which the liquid leaves the detection part 331. Based on the above disposition, the external liquid whose water quality has been detected by the detection part 331 can flow to the second detection opening 3332 through the first flow channel 336 and then be discharged. In addition, the third one-way valve 337-1 is disposed to prevent the liquid from flowing to the detection part 331 through a second flow channel 339. This reduces a possibility that the liquid whose water quality has been detected flows back to the detection part 331 and interferes with a detection result.

In some embodiments, the water quality detection module 330 includes a water purifier 338. The water purifier 338 communicates with the detection cavity 333. The water purifier 338 may purify the external liquid. The second drive pump 332 further has a fourth operating state. When the second drive pump 332 is in the fourth operating state, the second drive pump 332 drives the external liquid to flow through the water purifier 338 and then flow into the detection cavity 333 after the external liquid is purified and filtered, to rinse the detection part 331.

Based on the above disposition, when the detection part 331 completes water quality detection, the second drive pump 332 may be switched to the fourth operating state, so that the cleaned liquid flows through and cleans the detection part 331. The detection part 331 can be flushed with the cleaned liquid to remain clean. In this way, an error caused by accumulation of stains in the detection part 331 does not easily occur in a detection result, leading to stable performance of the water quality detection module 330.

A manner in which the water purifier 338 filters and purifies the external liquid includes, but is not limited to, disposing a micro-filtering film to filter out debris, disposing adsorption cotton to filter out debris, disposing alum to precipitate debris, and the like. When the external liquid flows through the water purifier 338, the external liquid is transformed into cleaned liquid with better water quality.

In some other embodiments, the water purifier 338 may further include a water storage tank. The water storage tank stores cleaned liquid. The cleaned liquid may be directly discharged from the water storage tank of the water purifier 338, so that the detection part 331 is rinsed.

In some embodiments, the water quality detection module 330 includes the second flow channel 339 and a fourth one-way valve 337-2. The second flow channel 339 communicates with the second detection opening 3332, or the second flow channel 339 directly communicates with the detection part 331. The water purifier 338 is disposed in the second flow channel 339. The fourth one-way valve 337-2 is disposed in the second flow channel 339. The fourth one-way valve 337-2 is configured to allow the liquid to unidirectionally flow in a direction in which the liquid enters the detection part 331. When the second drive pump 332 is in the fourth operating state, the second drive pump 332 drives the external liquid to flow sequentially to the water purifier 338 and the fourth one-way valve 337-2 through the second flow channel 339 and then flow into the detection cavity 333.

Based on the above disposition, when the detection part 331 completes water quality detection, the second drive pump 332 is switched to the fourth operating state, and the external liquid flows sequentially to the water purifier 338 and the fourth one-way valve 337-2 through the second flow channel 339 and then flows into the detection cavity 333. The external liquid is transformed into the cleaned liquid by the water purifier 338, and continues to flow to the detection part 331 to flush off the stains. The detection part 331 can be flushed with the cleaned liquid to remain clean, so that an error caused by accumulation of stains does not easily occur in a detection result, leading to stable performance of the water quality detection module 330. In addition, the fourth one-way valve 337-2 is disposed to prevent the external liquid that has been detected from flowing from the second flow channel 339 in a direction in which the liquid leaves the detection part 331, so that the cleaned liquid provided by the water purifier 338 cannot be easily contaminated by stains.

It may be understood that the water quality detection module 330 may be further provided with a third drive pump 334. The third drive pump 334 may be disposed in the second flow channel 339. The third drive pump 334 may drive the external liquid to flow through the water purifier 338 and then flow into the detection cavity 333 after the external liquid is purified and filtered, to rinse the detection part 331. In this way, when the detection part 331 completes water quality detection, the third drive pump 334 is started to drive the external liquid to flow sequentially to the water purifier 338 and the fourth one-way valve 337-2 through the second flow channel 339 and then flow into the detection cavity 333, so that the detection part 331 is rinsed to remain clean.

The external liquid in the second flow channel 339 is obtained by diverting liquid by other structures, such as the first detection opening 3331, or obtained by directly sucking liquid in from an external environment. In a specific embodiment, a third detection opening 335 is disposed on the detection cavity 333, and the second flow channel 339 communicates with the third detection opening 335. The third detection opening 335 is configured to allow the external liquid to flow into the water quality detection module 330. When the second drive pump 332 is in the fourth operating state, the external liquid enters the second flow channel 339 through the third detection opening 335, flows sequentially to the water purifier 338 and the fourth one-way valve 337-2, and then flows into the detection cavity 333.

FIG. 10 is a schematic flow chart of an automatic underwater spreading method according to some embodiments of the present disclosure. In some embodiments, the method 500 may be applied to the pool robot 100 in the above embodiments and may be performed by the control module 150. In some other embodiments, the method 500 may alternatively be applied to a pool cleaning system 300. For details about the pool cleaning system 300, refer to the following description. As shown in FIG. 10, the method 500 may include the following steps.

Step 510: Obtain a target region in a target water body and a target task corresponding to the target region. For example, the target water body may be a swimming pool. The target task includes a spreading task for the target region.

The target region may be a specific position in the target water body at which the target task needs to be performed. For example, the target region may be the entire swimming pool. For another example, the target region may further include a water surface of the swimming pool. For another example, the target region may further include each wall of the swimming pool. The spreading task may be a task of spreading a to-be-spread reagent in the target region.

In some embodiments, the target task may further include a cleaning task for the target region. The cleaning task may be a task of cleaning garbage or another debris in the target region.

The control module 150 may obtain the target task in various manners. For example, the control module 150 obtains the target task input by a user. For another example, the control module 150 may be configured to perform the target task periodically. For another example, the pool robot 100 may further include a detection module, and the detection module may perform water quality detection for each region in the target water body to obtain water quality data of each region. The control module 150 obtains the water quality data and determines the target task based on the water quality data. The water quality data may be data reflecting water quality of each region in the target water body. The water quality data includes, but is not limited to, a picture, a pH value, a total quantity of bacteria, free residual chlorine, urea, and the like of each region in the target water body.

In some embodiments, the control module 150 may input the water quality data into a task determining model, and an output of the task determining model may include the target task. The task determining model may analyze the water quality data of the target water body to determine cleanliness (such as clarity, algae distribution, and debris) of each region (such as the water surface, water in the pool, and each pool wall) to determine a corresponding target task. The task determining model may be a convolutional neural network model, a graph neural network model, or any machine learning model that can implement the above functions. The task determining model may be obtained by performing training based on a plurality of groups of training samples with labels. The training samples may include sample water quality data of each region in the sample water body, and the labels may include a sample task. The sample task may be obtained by manually labeling the sample water quality data.

In some embodiments, the obtaining a target region and a target task corresponding to the target region includes the following steps: selecting a water region and detecting water quality of the water region to obtain water quality data corresponding to the water region. The water region may be specified by a user or randomly selected in the target water body.

In a case where the water quality data exceeds a preset threshold, it indicates that the water region is the target region, and the corresponding target task is obtained based on the water quality data.

The control module 150 may further determine whether water quality data of each region in the target water body exceeds the preset threshold to determine the target task and the target region. The preset threshold may be a threshold at which water quality data of each region in the target water body does not meet a requirement. For example, the preset threshold may include a pH value of less than 6.5 or more than 8.5. When a pH value in water quality data of a region does not exceed the preset threshold, the region is determined as the target region. The corresponding target task may be the spreading task for the target region. The control module 150 may control the pool robot 100 to spread a pH adjuster to adjust the pH value of the target water body.

In some embodiments, the water quality data includes at least one of the pH value, the total quantity of bacteria, free residual chlorine, urea, the turbidity, the total quantity of solids, or the salinity. In a case where the water quality data exceeds the preset threshold, and the water quality data includes at least two of the pH value, the total quantity of bacteria, free residual chlorine, urea, the turbidity, the total quantity of solids, or the salinity, when at least any one of the at least two items exceeds the preset threshold, it is determined that the water quality data exceeds the preset threshold. In this way, the user may flexibly set a triggering condition of the target task, leading to flexible use.

In some embodiments, the selecting a water region and detecting water quality of the water region to obtain water quality data corresponding to the water region includes: obtaining coordinates of the water region and a requirement of detecting the water quality of the water region.

A coordinate system may be stored in the pool robot 100. The coordinate system may be set based on the target water body. The pool robot 100 may determine an actual position of the water region in the target water body based on the coordinates of the water region. The requirement of detecting the water quality may be a requirement initiated by the user or may be a task set to be performed periodically by the control module 150. The moving module 140 is controlled, based on the coordinates, to drive the pool robot 100 to reach the water region.

External liquid in the water region is drawn, enabling the external liquid to flow to the detection part 331 to obtain the water quality data by using the detection part 331.

The external liquid may be drawn by a component such as a second drive pump 332. In this way, the external liquid can be actively driven to flow to the detection part 331, so that the following case can be avoided: The detection part 331 cannot be passively in contact with the external liquid, causing the detection part 331 to fail to obtain the water quality data. This leads to stable detection.

In some embodiments, the method further includes: cleaning the detection part 331 when the detection part 331 completes detection.

The second drive pump 332 is controlled to drive cleaned liquid to flow to the detection part 331 to clean the detection part 331. The cleaned liquid is liquid whose water quality is greater than that of the external liquid. When the detection part 331 completes detection, the detection part 331 is flushed to be clean again as the cleaned liquid flows through. The cleaned liquid may be provided by the water purifier 338. The cleaned liquid may be stored in advance in the water purifier 338 or may be formed by purifying the external liquid by the water purifier 338. It may be understood that a third drive pump 334 can drive the cleaned liquid to flow to the detection part 331 to clean the detection part 331.

Step 520: Determine a first operating parameter of a drive module 120, a second operating parameter of the moving module 140, and a type and a dose of a to-be-spread reagent based on the target region and the target task.

The control module 150 may determine the first operating parameter of the drive module 120, the second operating parameter of the moving module 140, the type and the dose of the to-be-spread reagent based on the target task in various manners (such as regression analysis and discriminant analysis).

In some embodiments, the first operating parameter includes at least a speed at which the to-be-spread reagent leaves a storage module 110. The second operating parameter may include a moving speed and a motion path of the moving module 140. It may be understood that, when the target task includes only the cleaning task, the first operating parameter and the dose of the to-be-spread reagent may be 0.

In some embodiments, the control module 150 may determine, based on three-dimensional data of the target water body, the water quality data, and the target task, the first operating parameter, the second operating parameter, and the type and the dose of the to-be-spread reagent by using the parameter determining model. The three-dimensional data of the target water body may include, but is not limited to, a length, a width, and a height of the target water body, and a positional relationship between various vertices of the target water body.

The parameter determining model may be one or more of a graph neural network model, a convolutional neural network model, a deep neural network model, or any other machine learning model that can implement the above functions. The control module 150 may obtain the parameter determining model by performing training based on a plurality of groups of training samples with labels. The training samples may include sample three-dimensional data of the sample water body, sample water quality data, and a sample task. The labels may be a sample first operating parameter, a sample second operating parameter, a sample reagent type, and a sample reagent dose existing when the pool robot 100 performs the sample task for the sample water body. The training samples and the labels may be obtained by manually performing labeling based on historical maintenance data of the sample water body. The control module 150 may input the training samples into an initial parameter determining model, construct a loss function based on an output of the initial parameter determining model and the labels, iteratively update a parameter of the initial parameter determining model based on the loss function, and finish training until a preset condition is met, to obtain the trained parameter determining model. The preset condition may include, but is not limited to, that the loss function converges, a training period reaches a threshold, and the like.

In some embodiments of the present disclosure, various pieces of data of the target water body and the target task are processed by using the machine learning model, so that the type and the dose of the to-be-spread reagent, the first operating parameter, and the second operating parameter required for performing the target task for the target water body can be determined pertinently. In this way, the pool robot 100 can perform the target task for the target water body pertinently, and an error caused by manual calculation can be avoided. This shortens a maintenance period of the target water body and reduces maintenance costs.

In some embodiments, the output of the parameter determining model may further include a third operating parameter of a cleaning module 170. Correspondingly, when the parameter determining model is trained, the labels may further include a sample third operating parameter existing when the pool robot 100 performs the sample task for the sample water body. In this way, the pool robot 100 can be controlled more comprehensively. This shortens the maintenance period of the target water body and reduces maintenance costs.

Step 530: Control, based on the first operating parameter, the second operating parameter, and the type and the dose of the to-be-spread reagent, the pool robot 100 to complete the target task.

The control module 150 may determine, based on the type of the to-be-spread reagent, the storage module 110 (such as a certain storage cavity 113 storing the reagent of the corresponding type) connected to the drive module 120, and drive, based on the parameters of the pool robot 100, the to-be-spread reagent of the corresponding dose to leave the storage module 110. In addition, the control module 150 may further control, based on the parameters of the pool robot 100, the moving module 140 to move to complete the target task.

In some embodiments, the pool robot 100 includes a reagent dose detection module 101. The controlling, based on the first operating parameter, the second operating parameter, and the type and the dose of the to-be-spread reagent, the pool robot 100 to complete the target task includes the following steps.

The reagent dose detection module 101 is controlled to detect an in-position state of the storage module 110 and a storage quantity of to-be-spread reagents.

The in-position state of the storage module 110 indicates whether the storage module 110 is mounted on the pool robot 100. When the storage module 110 is mounted on the pool robot 100, the storage module 110 is in the in-position state. The reagent dose detection module 101 may separately detect the in-position state of the storage module 110 and the storage quantity of to-be-spread reagents. For example, the reagent dose detection module 101 may first detect the in-position state of the storage module 110 and then detect the storage quantity of to-be-spread reagents only when the storage module 110 is in the in-position state.

In a case where the storage module 110 is in the in-position state, and the storage quantity of to-be-spread reagents is greater than or equal to a reagent dose, the pool robot 100 is controlled to complete the target task. Only when the storage quantity of to-be-spread reagents is greater than or equal to the reagent dose, the control assembly may control the pool robot 100 to perform the target task. This helps reduce a probability that a water cleaning effect is reduced due to an insufficient storage quantity of to-be-spread reagents.

The pool robot 100 may further include a prompt module. The prompt module may send prompt information to the user. In a case where the storage module 110 is not in the in-position state or the storage quantity of to-be-spread reagents is less than the reagent dose, the control module 150 may further control the prompt module to send the prompt information to the user, to remind the user to replenish the to-be-spread reagent in time.

In some embodiments, the drive module 120 includes a first drive pump 121. The controlling the pool robot 100 to complete the target task includes the following steps.

The first drive pump 121 is controlled to generate a driving force in a direction from the storage module 110 to a reagent outlet 193 to complete the target task. When the first drive pump 121 generates the driving force in the direction from the storage module 110 to the reagent outlet 193, the to-be-spread reagent can be driven to leave the storage module 110.

The first drive pump 121 is controlled, in a case where the target task is completed, to generate a driving force in a direction from the reagent outlet 193 to the storage module 110. When the first drive pump 121 generates the driving force in the direction from the reagent outlet 193 to the storage module 110, residual liquid between the reagent outlet 193 and the storage module 110 is driven to flow to the storage module 110, so that a flow channel between the reagent outlet 193 and the storage module 110 is not easily blocked, and stains are not easily accumulated.

In some embodiments, that the first drive pump 121 is controlled, in a case where the target task is completed, to generate a driving force in a direction from the reagent outlet 193 to the storage module 110 includes: controlling the first drive pump 121 to continue to operate for preset duration and then stop operating. The preset duration may be 1 s, 2 s, 3 s, and the like. This is not limited herein. In this way, the residual liquid between the reagent outlet 193 and the storage module 110 can be better cleaned through suction, the flow channel between the reagent outlet 193 and the storage module 110 is not easily blocked, and stains are not easily accumulated. This improves a battery life of the pool robot 100.

It should be noted that the above description of the method 500 is merely used as an example for description and does not limit the scope of the present disclosure. For a person skilled in the art, various amendments and changes may be made to the method 500 under the guidance of the present disclosure. However, these amendments and changes shall fall within the scope of the present disclosure.

Figure 22:
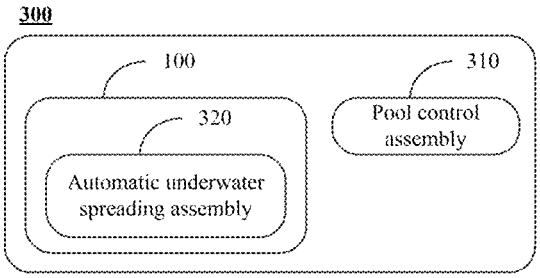
FIG. 22 is a first schematic structural diagram of a pool cleaning system according to some embodiments of the present disclosure.
Figure 23:
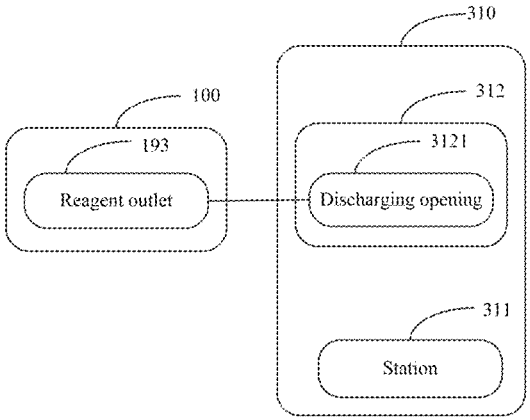
FIG. 23 is a second schematic structural diagram of a pool cleaning system according to some embodiments of the present disclosure.

With reference to FIG. 22 and FIG. 23, the present disclosure provides an automatic underwater spreading assembly 320. The automatic underwater spreading assembly 320 is configured to spread a reagent in a water body (for example, a swimming pool). The automatic underwater spreading assembly 320 may spread the reagent in water independently or may be combined with other structures to spread the reagent. For example, the automatic underwater spreading assembly 320 may automatically spread the reagent while floating on a water surface or fully submerging in the water body. The automatic underwater spreading assembly 320 may include a storage module 110, a drive module 120, and a control module 150.

The storage module 110 is configured to store a to-be-spread reagent. The to-be-spread reagent may be a reagent required by the automatic underwater spreading assembly 320 to perform maintenance for the water body, such as algae removal, clarification, and disinfection. The to-be-spread reagent may be solid or liquid. The to-be-spread reagent may include, but is not limited to, a clarifying agent, an algae removing agent, coagulant aids, disinfectant, a pH adjuster, and the like.

The drive module 120 is connected to the storage module 110. The drive module 120 may be configured to drive the to-be-spread reagent to leave the storage module 110, and/or the drive module 120 may be configured to adjust a flow rate at which the to-be-spread reagent leaves the storage module 110.

The drive module 120 may be configured to only drive the to-be-spread reagent to leave the storage module 110. The drive module 120 may alternatively be configured to only adjust a flow rate at which the to-be-spread reagent leaves the storage module 110. The drive module 120 may alternatively be configured to drive the to-be-spread reagent to leave the storage module 110 and adjust a flow rate at which the to-be-spread reagent leaves the storage module 110.

A manner in which the drive module 120 drives the to-be-spread reagent to leave the storage module 110 is not limited herein. In a specific embodiment, the drive module 120 includes a push structure. The push structure is in contact with the to-be-spread reagent and may move relative to the storage module 110. When the push structure moves, the push structure pushes the to-be-spread reagent in the storage module 110 to leave the storage module 110. In another specific embodiment, the drive module 120 includes a suction structure. The suction structure is connected to an outlet of the storage module 110. The suction structure may suck liquid located at the outlet of the storage module 110 to change pressure at the outlet of the storage module 110. When the pressure at the outlet of the storage module 110 is reduced by using the suction structure, the to-be-spread reagent is driven by a suction force to leave the storage module 110.

A manner in which the drive module 120 adjusts the flow rate at which the to-be-spread reagent leaves the storage module 110 is not limited herein. In a specific embodiment, the drive module 120 is provided with a flow channel. The flow channel is connected to the outlet of the storage module 110. The to-be-spread reagent flows out of the automatic underwater spreading assembly 320 through the flow channel. The drive module 120 may change a cross-sectional area of the flow channel to adjust the flow rate of the to-be-spread reagent.

The reagent outlet 193 may serve as an outlet for the to-be-spread reagent to leave the storage module 110 and then enter the liquid. The automatic underwater spreading assembly 320 may include one or more reagent outlets 193. As shown in FIG. 3B, the reagent outlet 193 may be disposed inside the automatic underwater spreading assembly 320. After the to-be-spread reagent flows out through the reagent outlet 193, the to-be-spread reagent may be mixed with another liquid (such as cleaned liquid) in space in which the reagent is located, and then flow out through a liquid outlet 192. For details about the cleaned liquid and the liquid outlet 192, refer to the following description. In some embodiments, the reagent outlet 193 may alternatively be disposed on a body 190 of the automatic underwater spreading assembly 320. For example, the reagent outlet 193 may be disposed on at least one of a top, a bottom, or a side portion of the body 190 of the automatic underwater spreading assembly 320, so that the to-be-spread reagent can enter the water directly through the reagent outlet 193 to complete spreading. In some embodiments, when the automatic underwater spreading assembly 320 floats on the water surface and spreads the reagent, the automatic underwater spreading assembly 320 may include at least one reagent outlet 193 located under the water surface or located close to the water to ensure that the to-be-spread reagent can enter the water. For example, when the automatic underwater spreading assembly 320 floats on the water surface and spreads the reagent, the reagent outlet 193 may be disposed on a side wall, of the body 190 of the automatic underwater spreading assembly 320, located under the water surface or disposed on the bottom of the body 190 of the automatic underwater spreading assembly 320.

The control module 150 is configured to control the drive module 120. The control module 150 may be connected to the drive module 120 via signals (such as Bluetooth connection) to control the drive module 120.

The control module 150 may control the drive module 120 based on a first operating parameter. The first operating parameter may be an operating parameter of the drive module 120. In some embodiments, the first operating parameter may include at least a speed at which the to-be-spread reagent leaves the storage module 110. For example, the first operating parameter may be a first water discharging speed, such as 0.25 mL/s, indicating that the drive module 120 drives 0.25 mL of the to-be-spread reagent to leave the storage module 110 per second.

In some embodiments, the first operating parameter may further include one or more of: a spreading time range, a drive interval, and drive duration. The spreading time range may be a time range in which the drive module 120 drives the to-be-spread reagent to leave the storage module 110. The drive interval may be an interval between two times of driving the to-be-spread reagent by the drive module 120 to leave the storage module 110. The drive duration may be duration in which the drive module 120 drives the to-be-spread reagent to leave the storage module 110. For example, the first operating parameter may further include the drive interval, such as 5 s, and the drive duration, such as 3 s. In other words, the drive module 120 may drive the to-be-spread reagent to leave the storage module 110 for 3 s, the drive module 120 takes a rest of 5 s, and then, the drive module 120 drives the to-be-spread reagent to leave the storage module 110 for 3 s, and the rest may be deduced by analogy. For another example, the first operating parameter may include the spreading time range, such as 13 s, and the drive duration, such as 5 s. In other words, within each spreading time range of 13 s, the drive module 120 may drive the to-be-spread reagent to leave the storage module 110 for 5 s. The drive duration of 5 s may be at any time range of the spreading time range. For example, the drive duration of 5 s may be the first 5 s or the last 5 s of the spreading time range.

Based on the above disposition, the automatic underwater spreading assembly 320 can automatically spread the reagent in the water in the pool without manual operation. This facilitates and simplifies water quality maintenance, shortens a maintenance period of the pool, and reduces maintenance costs.

In some embodiments, the automatic underwater spreading assembly 320 further includes a moving module 140. The moving module 140 may be configured to drive the automatic underwater spreading assembly 320 to move along a motion path. The moving module 140 may include various components configured to drive the automatic underwater spreading assembly 320 to move. As shown in FIG. 3A and FIG. 3B, the moving module 140 may include a track 141. The automatic underwater spreading assembly 320 may move at the bottom of the pool by using the track 141. The moving module 140 may further include a first propeller 142-1 and a second propeller 142-2. The liquid may be discharged through the first propeller 142-1 and the second propeller 142-2, so that a driving force is generated to drive the automatic underwater spreading assembly 320 to move in the water under an action force in a direction opposite to a water discharging direction.

The motion path may be a path at which the automatic underwater spreading assembly 320 moves when performing maintenance for the water body, such as algae removal, clarification, and disinfection. The motion path may be, but is not limited to, a rectangular motion path, a random motion path, a Z-shaped motion path, a spiral motion path, a square spiral motion path, and the like. The motion path may be set by a user (for example, a pool maintainer) as required. For example, when the automatic underwater spreading assembly 320 disinfects a large water body, the user may set the motion path as the spiral motion path or the square spiral motion path. In other words, the automatic underwater spreading assembly 320 may move in the water body along the spiral motion path or the square spiral motion path and spread disinfectant. The automatic underwater spreading assembly 320 may move from an outer side to an inner side of the water body until the entire surface of the water body is covered. In some embodiments, the motion path may be determined in other manners. For example, the control module 150 may determine the motion path based on a parameter determining model. For details about determining the motion path based on the parameter determining model, refer to FIG. 10 and related descriptions thereof.

In some embodiments of the present disclosure, the motion path of the automatic underwater spreading assembly 320 in the water body can be quickly and accurately determined based on the parameter determining model, so that the reagent can be spread pertinently. This improves maintenance efficiency of the water body and reduces maintenance costs.

When the automatic underwater spreading assembly 320 includes the moving module 140, the control module 150 is further configured to control the moving module 140. The control module 150 is connected to the moving module 140 via signals to control the moving module 140. The control module 150 may control the moving module 140 based on a second operating parameter. The second operating parameter may be an operating parameter of the moving module 140. The second operating parameter may include a moving speed and a motion path of the moving module 140.

In some embodiments, the control module 150 may determine the first operating parameter and the second operating parameter in various methods. The first operating parameter and/or the second operating parameter may be a preset default parameter. When the first operating parameter or the second operating parameter is a preset default parameter, the control module 150 may adjust one of the first operating parameter or the second operating parameter that is not the default parameter, to control a quantity of to-be-spread reagents per unit volume (for example, per $m^3$) in the water. When both the first operating parameter and the second operating parameter are preset default parameters, a concentration of the to-be-spread reagent may be adjusted in advance to adjust the quantity of reagents.

In some embodiments, the control module 150 may alternatively perform modeling or use various data analysis algorithms, such as regression analysis and discriminant analysis, to determine the first operating parameter and the second operating parameter. The control module 150 may determine the first operating parameter of the drive module 120 and/or the second operating parameter of the moving module 140 based on a target task. For details about the above embodiment, refer to FIG. 10 and related descriptions thereof.

Specifically, a working mode of the automatic underwater spreading assembly 320 may be that the control module 150 controls the moving module 140 to drive the automatic underwater spreading assembly 320 to move in the water and simultaneously controls the drive module 120 to operate. The to-be-spread reagent in the storage module 110 is driven by the drive module 120 to be spread in the water, so that the to-be-spread reagent is evenly spread.

In some embodiments of the present disclosure, the automatic underwater spreading assembly 320 is used to maintain the water body, so that the reagent is spread in the water automatically instead of being manually spread. In addition, it is ensured that the reagent is fully and evenly mixed with the water without any circulation system (such as a swimming pool circulation system). This can shorten a maintenance period of the water body and reduce maintenance costs.

In some embodiments, the storage module 110 may include a storage cavity 113. The storage cavity 113 is configured to store the to-be-spread reagent. In some embodiments, the storage module 110 may include one or more storage cavities 113. Different storage cavities 113 may be configured to store different to-be-spread reagents. When the storage module 110 includes a plurality of storage cavities 113, the drive module 120 may be connected to each storage cavity 113, so that the drive module 120 can drive a corresponding to-be-spread reagent to leave the storage cavity 113 when needed. In addition, a composite of various to-be-spread reagents may be spread to avoid the following case: The to-be-spread reagent stored in one storage cavity 113 needs to be replaced when different to-be-spread reagents need to be spread. An opening 114 is disposed on the storage cavity 113. The opening 114 is configured to allow the interior of the storage cavity 113 to communicate with an external environment. The opening 114 includes a second opening 114-2 and a first opening 114-1. The second opening 114-2 is configured to allow fluid to enter the storage cavity 113. The fluid may be the to-be-spread reagent. The first opening 114-1 is configured to allow fluid to leave the storage cavity 113.

The first opening 114-1 may be connected to other structures, so that the to-be-spread reagent can flow from the storage module 110 to the other structures. Alternatively, the first opening 114-1 may not be connected to other structures, so that the to-be-spread reagent can be spread directly in the water through the first opening 114-1. The second opening 114-2 and the first opening 114-1 may be respectively disposed on two opposite sides of the storage cavity 113. For example, in a gravity direction, a side of the storage cavity 113 faces downward, the first opening 114-1 is disposed on the side, a side of the storage cavity 113 faces upward, and the second opening 114-2 is disposed on the side, so that the to-be-spread reagent can enter the storage cavity 113 through the second opening 114-2 and leave the storage cavity 113 through the first opening 114-1 under gravity.

Based on the above disposition, when the to-be-spread reagent in the storage cavity 113 is insufficient, a user may replenish the to-be-spread reagent into the storage cavity 113 through the second opening 114-2, which is convenient to operate.

In some embodiments, a first one-way valve 115 is disposed in the second opening 114-2. The first one-way valve 115 is configured to allow fluid to unidirectionally flow in a direction in which the fluid enters the storage cavity 113. The first one-way valve 115 may be a known one-way valve, provided that the fluid can unidirectionally flow. Details are not described herein. The first one-way valve 115 is disposed, so that the to-be-spread reagent does not easily leak out of the storage module 110 through the second opening 114-2, leading to good sealing performance of the storage cavity 113.

In some embodiments, a sealing cover 116 detachably covers an end of the second opening 114-2, and the end is away from the storage cavity 113. When the sealing cover 116 covers the second opening 114-2, the second opening 114-2 is closed, and the external liquid cannot enter the second opening 114-2. When the sealing cover 116 is detached from the second opening 114-2, the second opening 114-2 is opened, and the external liquid can enter the storage cavity 113 through the second opening 114-2. Based on the above disposition, the sealing cover 116 can reduce a probability that external debris enters the storage cavity 113, so that the to-be-spread reagent is not easily contaminated, leading to a good cleaning effect of the automatic underwater spreading assembly 320.

The second opening 114-2 may directly communicate with the external environment or may be connected to other structures, and the to-be-spread reagent is indirectly added to the storage cavity 113 through the other structures.

In one embodiment, the automatic underwater spreading assembly 320 further includes a body 190. The body 190 is configured to carry the drive module 120, the moving module 140, and the like. The storage cavity 113 is disposed in the body 190. A liquid adding opening is disposed on the body 190. The liquid adding opening communicates with the second opening 114-2. When the to-be-spread reagent flows to the liquid adding opening, the to-be-spread reagent flows to the second opening 114-2 through the liquid adding opening and then enters the storage cavity 113.

Based on the above disposition, the user may add the to-be-spread reagent to the storage cavity 113 through the liquid adding opening instead of directly through the second opening 114-2. A position at which the storage cavity 113 is mounted may not be limited to a position close to a surface of the automatic underwater spreading assembly 320, leading to a more flexible structural design. In addition, the liquid adding opening may be disposed at a position that is easier for the user to operate, leading to convenient operation.

In some embodiments, a liquid inlet pump is disposed at the second opening 114-2. The liquid inlet pump is configured to drive the liquid to enter the storage cavity 113. The liquid inlet pump may be a peristaltic pump or any other pump that can implement the above function. The liquid inlet pump may change a flow rate at which the liquid enters the storage cavity 113. The to-be-spread reagent cannot leave the storage cavity 113 before being mixed with the liquid. For example, the to-be-spread reagent may be solid. The to-be-spread reagent may be gradually dissolved in the liquid. When the flow rate at which the liquid enters the storage cavity 113 changes, a speed at which the to-be-spread reagent is mixed with the liquid changes. For example, when the flow rate at which the liquid enters the storage cavity 113 increases, the speed at which the to-be-spread reagent is mixed with the liquid increases. In this case, a speed at which the to-be-spread reagent leaves the storage cavity 113 increases. Based on the above disposition, the storage module 110 controls the speed at which the to-be-spread reagent leaves the storage cavity 113 by controlling an operating state of the liquid inlet pump. This facilitates simple control and convenient use.

In some other embodiments, the storage module 110 includes a storage cavity 113. An opening 114 is disposed on the storage cavity 113. The opening 114 is configured to allow the to-be-spread reagent to enter and leave the storage cavity 113. A first one-way valve 115 is detachably disposed in the opening 114. The first one-way valve 115 is configured to allow fluid to unidirectionally flow in a direction in which the fluid enters the storage cavity 113. The fluid may be the to-be-spread reagent. When the first one-way valve 115 is disposed in the opening 114, the fluid can only enter the storage cavity 113. When the first one-way valve 115 is detached from the opening 114, the fluid can enter or leave the storage cavity 113.

Based on the above disposition, the user may control the to-be-spread reagent to enter or leave the storage cavity 113 by mounting or detaching the first one-way valve 115. Only one opening 114 needs to be disposed on the storage cavity 113, leading to a simple structure.

In some embodiments, the storage cavity 113 may include a flexible storage cavity 113 and/or a rigid storage cavity 113. In some embodiments, the storage cavity 113 further includes a sealing member. The sealing member is configured to allow the to-be-spread reagent to be sealingly stored in the storage cavity 113, to prevent the to-be-spread reagent from leaking into the external liquid. The sealing member may be any structure capable of sealing the storage cavity 113. For example, when the storage cavity 113 is the rigid storage cavity 113, the sealing member may be a sealing cover 116. Thread structures that mate with each other may be disposed on a body of the rigid storage cavity 113 and the sealing cover 116. The sealing cover 116 may be configured to seal the rigid storage cavity 113 through the thread structures. The sealing cover 116 may alternatively be a sealing structure 220 such as a rubber plug.

The to-be-spread reagent may be stored in the flexible storage cavity 113. The flexible storage cavity 113 may be made of a flexible material. The flexible material may include, but is not limited to, one or more of polyvinyl alcohol resin, polyethylene terephthalate, rubber, and the like. The flexible material has certain flexibility, so that the flexible storage cavity 113 can be deformed. It may be understood that when the to-be-spread reagent leaves the flexible storage cavity 113, space of the flexible storage cavity 113 is reduced accordingly, so that pressure inside the flexible storage cavity 113 is automatically adjusted to ensure a balance between water pressure inside and water pressure outside the flexible storage cavity 113. In this way, the to-be-spread reagent can leave smoothly.

In some embodiments, the flexible storage cavity 113 may be a flexible storage bag. The flexible storage bag may store a liquid to-be-spread reagent or a solid to-be-spread reagent that is dissolved in the liquid in advance. Before use, the to-be-spread reagent may be stored in the flexible storage bag, and the to-be-spread reagent may be sealed in the flexible storage bag through a heat sealing process. An outlet of the flexible storage bag may be connected to an end of a drive pump. In some embodiments, the flexible storage cavity 113 may be in other flexible structures. For example, the flexible storage cavity 113 may alternatively be a flexible storage ball.

The to-be-spread reagent may alternatively be stored in the rigid storage cavity 113. An outlet of the rigid storage cavity 113 is connected to the drive module 120. The rigid storage cavity 113 may be made of a rigid material (such as glass or ceramic). It may be understood that, because the rigid material is not deformed easily, pressure inside the rigid storage cavity 113 changes when the to-be-spread reagent leaves the rigid storage cavity 113, and if water pressure is not adjusted, the remaining to-be-spread reagent cannot leave the rigid storage cavity 113 smoothly. In some embodiments, the rigid storage cavity 113 may include a pressure adjustment member. The pressure adjustment member may be configured to adjust the pressure inside the rigid storage cavity 113, so that a balance between pressure inside and pressure outside the rigid storage cavity 113 is ensured. For example, when the to-be-spread reagent leaves the rigid storage cavity 113, the pressure adjustment member may drive gas to be input into the rigid storage cavity 113 to ensure the balance between the pressure (for example, air pressure and/or water pressure) inside and the water pressure outside the rigid storage cavity 113. In this way, the to-be-spread reagent can leave smoothly.

In some embodiments, when the automatic underwater spreading assembly 320 includes the flexible storage cavity 113 and the rigid storage cavity 113, the flexible storage cavity 113 may be disposed inside the rigid storage cavity 113 to protect the flexible storage cavity 113 from being damaged.

In some embodiments, openings 114 are disposed on the storage cavity 113. The openings 114 include an avoidance opening 118 and a connection opening 119. The avoidance opening 118 is disposed on the rigid storage cavity 113. The connection opening 119 is disposed on the flexible storage cavity 113. The connection opening 119 passes through the avoidance opening 118 and extends to an outer surface of the rigid storage cavity 113. A first one-way valve 115 is disposed in the connection opening 119. The first one-way valve 115 is configured to allow the to-be-spread reagent to unidirectionally flow. In this way, the to-be-spread reagent can enter, through the protruding connection opening 119, the flexible storage cavity 113 located inside the rigid storage cavity 113.

Further, the connection opening 119 includes a rigid connection portion 119-1. Rigidness of the rigid connection portion 119-1 is greater than that of the flexible storage cavity 113. The rigid connection portion 119-1 has certain rigidness and is not deformed easily. The rigid connection portion 119-1 passes through the avoidance opening 118. A peripheral surface of the rigid connection portion 119-1 is attached to an inner wall of the avoidance opening 118. In this way, when the to-be-spread reagent is added to the flexible storage cavity 113, a shape of the rigid connection portion 119-1 may be better maintained, and the rigid connection portion 119-1 is not collapsed easily, leading to a stable process of adding the to-be-spread reagent. In addition, the peripheral surface of the rigid connection portion 119-1 is attached to the inner wall of the avoidance opening 118, so that liquid, debris, and the like cannot easily enter space between the flexible storage cavity 113 and the rigid storage cavity 113, and the storage module 110 can remain clean.

In some embodiments, the automatic underwater spreading assembly 320 further includes a body 190. The body 190 is configured to carry the drive module 120, the moving module 140, and the like. The storage module 110 is detachably disposed on the body 190. Based on the above disposition, when the to-be-spread reagent in the automatic underwater spreading assembly 320 is insufficient, the storage module 110 is directly replaced to replenish the to-be-spread reagent, leading to convenient use.

In some embodiments, the drive module 120 includes a first drive pump 121. The first drive pump 121 is configured to drive the to-be-spread reagent to leave the storage module 110. The first drive pump 121 may be a peristaltic pump or any other pump (such as a syringe pump) that can implement the function. One end of the first drive pump 121 communicates with the outlet of the storage module 110, and the other end of the first drive pump 121 communicates with the reagent outlet 193. One end of the first drive pump 121 directly communicates with the reagent outlet 193 or communicates with the reagent outlet 193 through other components of the automatic underwater spreading assembly 320.

In some embodiments, as shown in FIG. 3A and FIG. 3B, the first drive pump 121 may include a first drive pump body 121-1, a first duct 121-2, and a second duct 121-3. The first drive pump body 121-1 may be configured to provide a driving force for the to-be-spread reagent to leave the storage module 110. The first duct 121-2 may be configured as a channel for the to-be-spread reagent to leave the storage module 110. One end of the first duct 121-2 communicates with the outlet of the storage module 110, and the other end of the first duct 121-2 is connected to the first drive pump body 121-1. The second duct 121-3 may be configured to guide the to-be-spread reagent to the reagent outlet 193. One end of the second duct 121-3 is connected to the first drive pump body 121-1, and the other end of the second duct 121-3 communicates with the reagent outlet 193. In this way, the to-be-spread reagent is driven by the first drive pump body 121-1 to leave through the outlet of the storage module 110 and flow out of the reagent outlet 193 through the first duct 121-2 and the second duct 121-3.

In some embodiments of the present disclosure, the first drive pump 121 drives the to-be-spread reagent to leave the storage module 110 and be spread in the water, so that the automatic underwater spreading assembly 320 can evenly and comprehensively spread the reagent with high spreading efficiency.

In some embodiments, the first drive pump 121 has a first operating state and a second operating state. When the first drive pump 121 is in the first operating state, the first drive pump 121 generates a driving force in a direction from the storage module 110 to the reagent outlet 193, and the first drive pump 121 drives the to-be-spread reagent to leave the storage module 110. When the first drive pump 121 is in the second operating state, the first drive pump 121 generates a driving force in a direction from the reagent outlet 193 to the storage module 110, and the first drive pump 121 drives residual liquid between the reagent outlet 193 and the storage module 110 to move to the storage module 110, so that a flow channel between the reagent outlet 193 and the storage module 110 is unobstructed. In this way, the first drive pump 121 drives the to-be-spread reagent to leave the storage module 110 in the first operating state, and the first drive pump 121 is switched to the second operating state after the reagent is spread, so that the residual liquid between the reagent outlet 193 and the storage module 110 is pumped out and discharged. In this way, the flow channel between the reagent outlet 193 and the storage module 110 is not easily blocked.

In some embodiments, the drive module 120 may include a piston drive member. The piston drive member may move in the rigid storage cavity 113 to squeeze the to-be-spread reagent out of the rigid storage cavity 113.

In some embodiments of the present disclosure, the pressure adjustment member adjusts the pressure in the rigid storage cavity 113, and the piston drive member is used to squeeze the to-be-spread reagent out of the rigid storage cavity 113, so that the to-be-spread reagent can be spread evenly in the water to ensure that an appropriate quantity of reagents are sufficiently mixed with the water in the pool.

Figure 4:
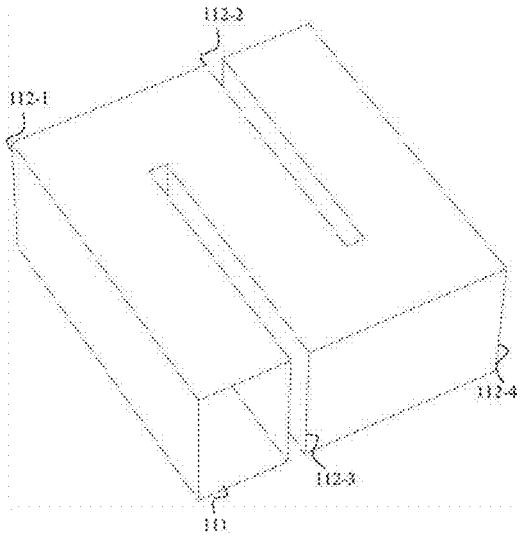
FIG. 4 is a schematic diagram of a rigid storage module according to some embodiments of the present disclosure.
Figure 5:
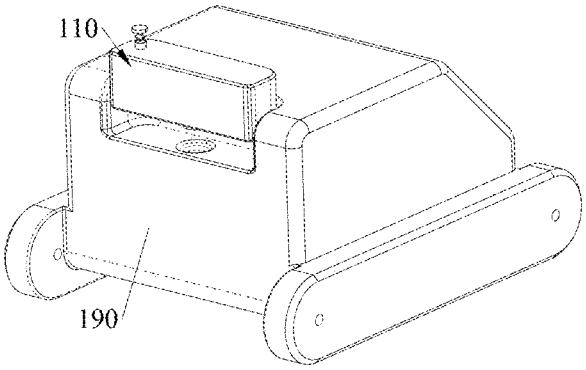
FIG. 5 is a second schematic structural diagram of a pool robot according to some embodiments of the present disclosure.
Figure 6:
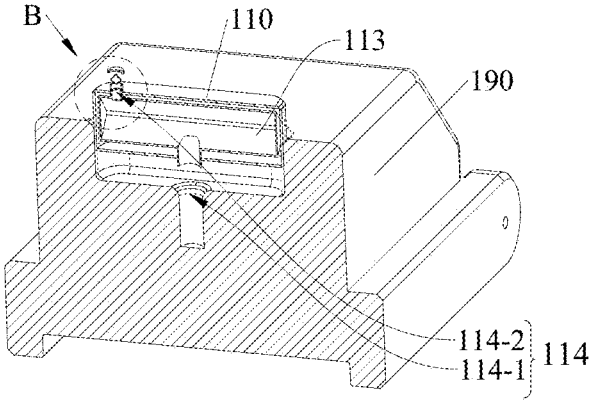
FIG. 6 is another schematic cross-sectional diagram of a pool robot according to some embodiments of the present disclosure.
Figure 7:
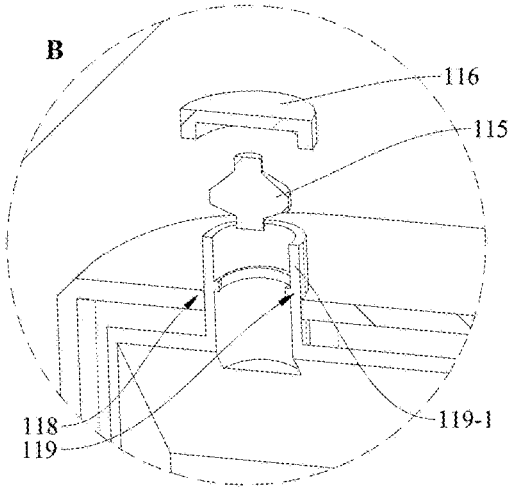
FIG. 7 is an enlarged schematic diagram of a portion B in FIG. 6.

The rigid storage cavity 113 may be in various shapes. For example, the rigid storage cavity 113 may be rectangular or cylindrical. In some embodiments, the rigid storage cavity 113 may include at least one bent portion. The bent portion may be bent at a right angle or another angle, or may be curvedly bent. As shown in FIG. 4, the rigid storage cavity 113 may include a rigid storage cavity outlet 111, a first bent portion 112-1, a second bent portion 112-2, a third bent portion 112-3, and a fourth bent portion 112-4. Each of the first bent portion 112-1, the second bent portion 112-2, the third bent portion 112-3, and the fourth bent portion 112-4 is bent at a right angle.

It may be understood that when the rigid storage cavity 113 is a hollow rectangle or other structures without any bent portion, and the piston drive member moves in the rigid storage cavity 113, if a volume of the rigid storage cavity 113 is large, the piston drive member may squeeze out a large quantity of to-be-spread reagents even when moving for a short distance, which is inconvenient to precisely control the spread quantity of to-be-spread reagents, or if the volume of the rigid storage cavity 113 is small, the spread quantity of to-be-spread reagents can be precisely controlled, but a total volume of the rigid storage cavity 113 for storing the to-be-spread reagents is small, leading to inconvenient use. In some embodiments of the present disclosure, at least one bent portion is disposed in the rigid storage cavity 113, so that the rigid storage cavity 113 is divided into a plurality of small duct structures. In this way, while the total volume of the rigid storage cavity 113 for storing the to-be-spread reagents is ensured, the spread quantity of to-be-spread reagents can be precisely controlled.

Figure 8:
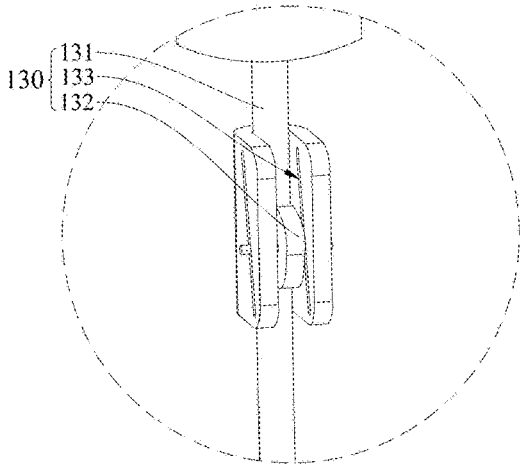
FIG. 8 is a schematic diagram of a partial structure of an adjustment assembly according to some embodiments of the present disclosure.

In some embodiments, with reference to FIG. 8, the to-be-spread reagent leaves the storage cavity 113 under gravity. The drive module 120 is configured to adjust a flow rate at which the to-be-spread reagent leaves the storage module 110. The drive module 120 includes a spreading duct 131 and a flow rate adjustment part 132. The spreading duct 131 communicates with an outlet of the storage cavity 113. The to-be-spread reagent is spread in the water through the spreading duct 131. The flow rate adjustment part 132 is configured to change a flow rate of fluid in the spreading duct 131. Based on the above disposition, when spreading the to-be-spread reagent, the automatic underwater spreading assembly 320 can precisely control a dose of the spread reagent. This facilitates convenient use and helps reduce a quantity of to-be-spread reagents and reduce costs.

A specific manner in which the flow rate adjustment part 132 changes the flow rate in the spreading duct 131 may be changing a cross-sectional area of the spreading duct 131 or a size of the outlet of the storage cavity 113. This is not limited herein.

In a specific embodiment, the flow rate adjustment part 132 covers the outlet of the storage cavity 113. The flow rate adjustment part 132 may move relative to the storage cavity 113 to change an opening area of the outlet of the storage cavity 113.

In another specific embodiment, a wall of the spreading duct 131 may be elastic. The flow rate adjustment part 132 may move relative to the spreading duct 131 between a first position and a second position. The first position may be a position away from the spreading duct 131. The second position may be a position close to the spreading duct 131. In a process in which the flow rate adjustment part 132 moves from the first position to the second position, the flow rate adjustment part 132 is in contact with and squeezes the spreading duct 131, enabling the cross-sectional area of the flow rate duct to be changed. In this way, the flow rate adjustment part 132 can squeeze the spreading duct 131 to change the flow rate in the spreading duct 131, leading to a simple structure.

In some embodiments, the drive module 120 further includes a position-limiting groove 133. The position-limiting groove 133 is disposed on a side of the spreading duct 131. A shortest distance from the position-limiting groove 133 to an axis of the spreading duct 131 gradually increases or decreases in an axial direction of the spreading duct 131. In other words, the position-limiting groove 133 tilts relative to the axis of the spreading duct 131. The flow rate adjustment part 132 is slidably disposed in the position-limiting groove 133. The flow rate adjustment part 132 slides between the first position and the second position along the position-limiting groove 133. Based on the above disposition, the flow rate adjustment part 132 can slide along the position-limiting groove 133, and the position-limiting groove 133 may guide movement of the flow rate adjustment part 132. In this way, the flow rate adjustment part 132 can precisely move to the first position or the second position, and the drive module 120 can adjust the flow rate of the to-be-spread reagent more precisely.

The movement of the flow rate adjustment part 132 may be controlled by the control module 150 or manually controlled. A shape of the flow rate adjustment part 132 may be determined based on an actual situation, provided that the flow rate adjustment part 132 can squeeze the spreading duct 131. This is not limited herein. In a specific embodiment, the flow rate adjustment part 132 includes a squeezing portion in a round-disc shape and a rotation shaft disposed on a side of the squeezing portion. The rotation shaft is slidably embedded in the position-limiting groove 133. A periphery of the squeezing portion squeezes the spreading duct 131.

In some embodiments, the drive module 120 may include the first drive pump 121, the spreading duct 131, and the flow rate adjustment part 132. The first drive pump 121 may be configured to provide a driving force for the to-be-spread reagent to leave the storage module 110. The spreading duct 131 may be disposed between the storage cavity 113 and the first drive pump 121. One end of the spreading duct 131 communicates with the outlet of the storage cavity 113, and the other end of the spreading duct 131 communicates with the first drive pump 121. The spreading duct 131 may alternatively be disposed between the first drive pump 121 and the reagent outlet 193. One end of the spreading duct 131 communicates with the first drive pump 121, and the other end of the spreading duct 131 communicates with the reagent outlet 193. In this way, the drive module 120 can drive the to-be-spread reagent to leave the storage module 110 and adjust the flow rate at which the to-be-spread reagent leaves the storage module 110.

In some embodiments, with reference to FIG. 11 to FIG. 21, the automatic underwater spreading assembly 320 further includes a sealing structure 220. A liquid inlet portion 2101 is disposed on the body 190. The liquid inlet portion 2101 is configured to allow the to-be-spread reagent to enter the body 190. The liquid inlet portion 2101 may be concave. The reagent outlet 193 is disposed on the body 190. The reagent outlet 193 communicates with the liquid inlet portion 2101. The storage module 110 includes the storage cavity 113 and a second one-way valve 2201 communicating with the storage cavity 113. The storage module 110 is disposed on the body 190. At least a part of the second one-way valve 2201 extends into the liquid inlet portion 2101. The second one-way valve 2201 is configured to allow the liquid to unidirectionally flow, so that at least a part of liquid in the storage cavity 113 can flow into the liquid inlet portion 2101 through the second one-way valve 2201. At least a part of the sealing structure 220 is located in the liquid inlet portion 2101 to seal a joint between the second one-way valve 2201 and the liquid inlet portion 2101.

According to the technical solution of this embodiment, during operation of the automatic underwater spreading assembly 320, the sealing structure 220 can seal the joint between the second one-way valve 2201 and the liquid inlet portion 2101, that is, the sealing structure 220 seals an assembling gap between an inner wall of the liquid inlet portion 2101 and an outer circumferential surface of the second one-way valve 2201, to prevent the water in the pool from flowing into the liquid inlet portion 2101 through the assembling gap. This resolves a problem in the conventional technology that the water in the pool enters the automatic underwater spreading assembly 320 during operation of the automatic underwater spreading assembly 320. In this way, the following case is avoided: The reagent is ineffective because the reagent in the body 190 is diluted with the water in the pool. This improves cleaning reliability of the automatic underwater spreading assembly 320. In addition, debris in the water in the pool is prevented from entering the body 190, and therefore, a component inside the body 190 is prevented from being blocked or even damaged by the debris. This extends a service life of the automatic underwater spreading assembly 320.

In some embodiments, the sealing structure 220 includes a through hole 222 configured to allow the second one-way valve 2201 to pass through. The through hole 222 communicates with the liquid inlet portion 2101. The automatic underwater spreading assembly 320 further includes a blocking structure 230. At least a part of the blocking structure 230 is movably disposed in the liquid inlet portion 2101. The blocking structure 230 is configured to block the through hole 222 and has a blocking state and an open state. When the storage module 110 is detached from the body 190, the blocking structure 230 is switched to the blocking state to block the through hole 222. When the storage module 110 is assembled on the body 190, the blocking structure 230 is switched to the open state to avoid at least a part of the through hole 222, so that the second one-way valve 2201 communicates with the liquid inlet portion 2101.

After the storage module 110 is detached from the body 190, the water in the pool enters the liquid inlet portion 2101 through the through hole 222. Consequently, the water in the pool flows into the automatic underwater spreading assembly 320 through the through hole 222 and the liquid inlet portion 2101. The blocking structure 230 is disposed, so that the through hole 222 can be blocked by the blocking structure 230 in the blocking state after the storage module 110 is detached. In this way, the water or other substances in the pool are prevented from flowing into the body 190 through the through hole 222, so that a pipeline for spreading the reagent is prevented from being blocked, and therefore, reagent spreading performed by the automatic underwater spreading assembly 320 is not affected. In addition, when the storage module 110 is assembled on the body 190, the blocking structure 230 is switched to the open state, so that the reagent discharged through the second one-way valve 2201 can flow into the body 190, ensuring that the blocking structure 230 does not affect normal operation of the automatic underwater spreading assembly 320.

Specifically, when the automatic underwater spreading assembly 320 operates, the storage module 110 may be assembled to or detached from the automatic underwater spreading assembly 320. The blocking structure 230 is disposed to block the through hole 222, so that the water in the pool is prevented from being sucked in the liquid inlet portion 2101 through the through hole 222 when the storage module 110 is detached from the automatic underwater spreading assembly 320. In this way, the reagent in the liquid inlet portion 2101 is prevented from being diluted. This improves the cleaning reliability of the automatic underwater spreading assembly 320.

Specifically, when the automatic underwater spreading assembly 320 stops operating, if the storage module 110 is detached, the through hole 222 is blocked by the blocking structure 230. In this way, the to-be-spread reagent in the liquid inlet portion 2101 can be sealed, so that the following case is avoided: The to-be-spread reagent is ineffective because media, such as air and debris, enter the liquid inlet portion 2101 through the through hole 222. This extends effective time of the to-be-spread reagent and prevents the to-be-spread reagent from being wasted.

In an embodiment, when the blocking structure 230 is switched to the blocking state, the blocking structure 230 moves toward the sealing structure 220. When the blocking structure 230 is switched to the open state, the second one-way valve 2201 pushes the blocking structure 230 to move away from the sealing structure 220. In this way, the blocking structure 230 moves, so that states of the blocking structure 230 can be switched, which is simpler and easier. In addition, while the storage module 110 is mounted, the second one-way valve 2201 can push the blocking structure 230 to move to the open state to ensure that the blocking structure 230 does not affect normal liquid transfer of the storage module 110 after the storage module 110 is mounted, so that operation reliability of the automatic underwater spreading assembly 320 is improved.

In some embodiments not shown in the accompanying drawings, a manner in which the blocking structure 230 blocks the through hole 222 may be determined based on an operating condition and a use requirement. For example, the blocking structure 230 is configured as a clamping structure. The blocking structure 230 clamps or loosens the sealing structure 220, so that the sealing structure 220 is deformed, and the blocking structure 230 blocks or avoids the through hole 222. Alternatively, the blocking structure 230 is movably disposed on the sealing structure 220, and the blocking structure 230 moves along a surface of the sealing structure 220, so that the blocking structure 230 blocks or avoids the through hole 222.

Figure 14:
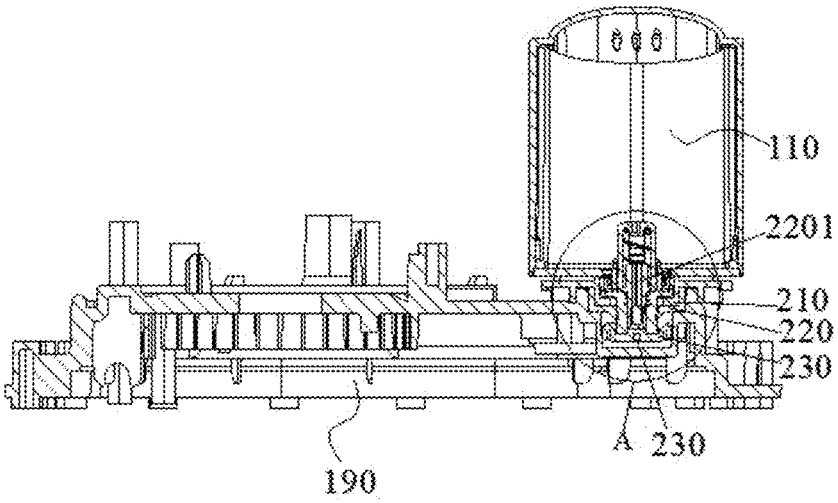
FIG. 14 is a schematic cross-sectional diagram of the structure in FIG. 13.
Figure 15:
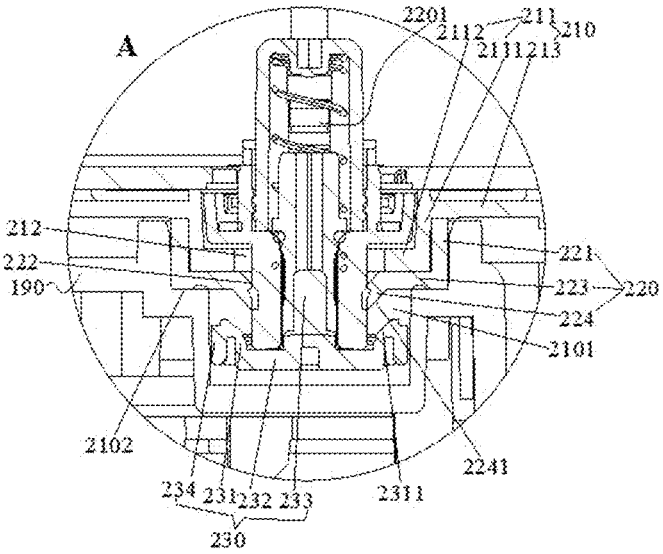
FIG. 15 is an enlarged schematic diagram of a portion A in FIG. 14.
Figure 16:
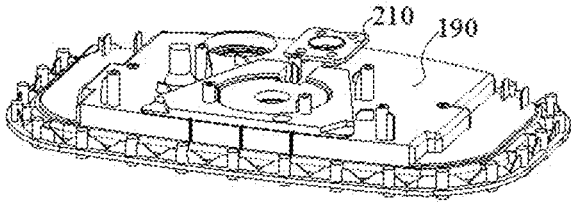
FIG. 16 is a schematic diagram of a three-dimensional structure existing when the sealing structure and the blocking structure in FIG. 11 are assembled on a pool robot.
Figure 17:
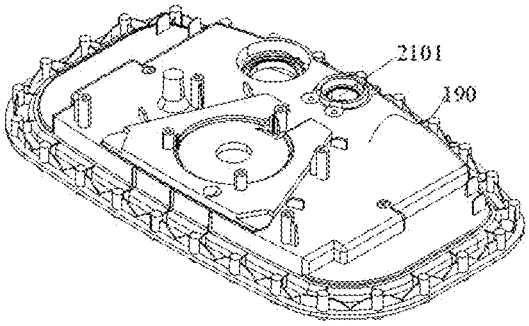
FIG. 17 is a schematic diagram of a three-dimensional structure of a part of the pool robot in FIG. 16 on which the sealing structure and the blocking structure are assembled.
Figure 18:
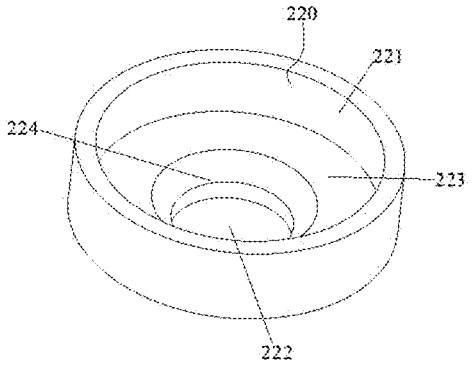
FIG. 18 is a schematic diagram of a three-dimensional structure of the sealing structure of a pool robot in FIG. 11.
Figure 19:
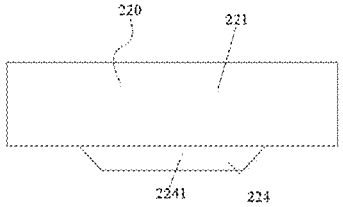
FIG. 19 is a front view of the sealing structure in FIG. 18.
Figure 20:
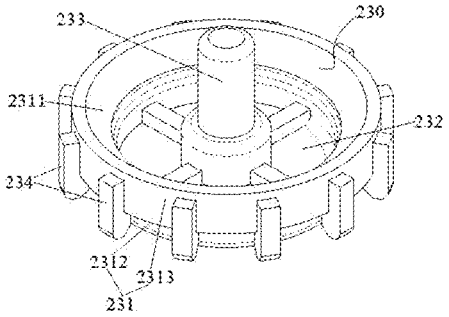
FIG. 20 is a schematic diagram of a three-dimensional structure of the blocking structure of a pool robot in FIG. 11.
Figure 21:
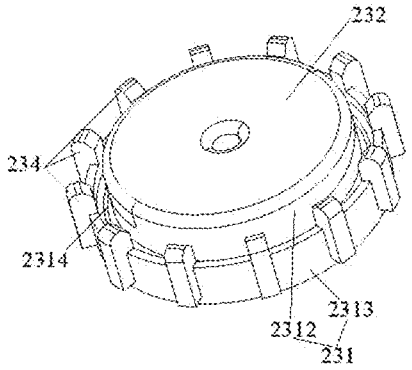
FIG. 21 is another schematic diagram of a three-dimensional structure of the blocking structure of a pool robot in FIG. 11.

As shown in FIG. 14 and FIG. 15, the liquid inlet portion 2101 is concave. The automatic underwater spreading assembly 320 further includes an elastic structure. One end of the elastic structure is connected to the blocking structure 230. The other end of the elastic structure is connected to a bottom wall of the liquid inlet portion 2101. The elastic structure is configured to allow the blocking structure 230 to reset to the blocking state. In this way, after the storage module 110 is detached, the blocking structure 230 can be automatically reset to the blocking state under an elastic force of the elastic structure without manual reset. This improves automation of the automatic underwater spreading assembly 320 and reduces labor intensity. In addition, the elastic structure can also push the blocking structure 230 to improve tightness of contact between the blocking structure 230 and the sealing structure 220. This improves blocking reliability of the blocking structure 230.

Optionally, the elastic structure may be a spring.

In some embodiments, the elastic structure is sleeved on at least a part of the blocking structure 230. In this way, the blocking structure 230 supports and guides the elastic structure, so that the elastic structure can be prevented from deviating and being deformed, and the blocking structure 230 can be reset to the blocking state by using the elastic structure. This further improves resetting reliability of the elastic structure.

Specifically, one end of the elastic structure is connected to the blocking structure 230. The other end of the elastic structure is connected to the bottom wall of the liquid inlet portion 2101. The spring applies the elastic force to the blocking structure 230 in a direction toward the sealing structure 220, so that the blocking structure 230 is reset to the blocking state.

In some embodiments, when the blocking structure 230 is in the open state, there is a preset distance between the blocking structure 230 and an end of the sealing structure 220, where the end is provided with the through hole 222, so that a flow gap is formed between at least a part of the blocking structure 230 and the sealing structure 220. In this way, the second one-way valve 2201 communicates with the liquid inlet portion 2101 through the flow gap. In this way, when the blocking structure 230 is in the open state, the flow gap is formed between the blocking structure 230 and the sealing structure 220, so that the liquid flowing out of the second one-way valve 2201 can flow into the liquid inlet portion 2101 through the flow gap. This further improves the operation reliability of the automatic underwater spreading assembly 320.

As shown in FIG. 14 and FIG. 15, a stepped surface 2102 is disposed in the liquid inlet portion 2101. The sealing structure 220 includes a first sealing portion 221 and a second sealing portion connected to each other. The second sealing portion is disposed on the stepped surface 2102. The first sealing portion 221 is located on a side of the second sealing portion, and the side is away from the stepped surface 2102. The second sealing portion includes the through hole 222. An inner wall of the through hole 222 is in an interference fit with the outer circumferential surface of the second one-way valve 2201. The first sealing portion 221 is configured to seal at least a part of the gap between the second one-way valve 2201 and the liquid inlet portion 2101. In this way, a structure of the sealing structure 220 can mate with a structure of the liquid inlet portion 2101. This increases a sealing area of the sealing structure 220 and improves sealing reliability of the sealing structure 220. In addition, because the through hole 222 is in an interference fit with the second one-way valve 2201, the liquid flowing to the sealing structure 220 is blocked outside the sealing structure 220. This further improves the sealing reliability of the sealing structure 220.

The first sealing portion 221 is tubular. The second sealing portion includes an annular sealing portion 223 and a conical sealing portion 224. The annular sealing portion 223 is connected to the first sealing portion 221. The conical sealing portion 224 is connected to the annular sealing portion 223. The conical sealing portion 224 is disposed at an inner hole of the annular sealing portion 223 and is located at a side of the annular sealing portion 223, and the side is away from the first sealing portion 221. An end of the conical sealing portion 224 is away from the annular sealing portion 223, and the end is the through hole 222. In this way, the conical sealing portion 224 is disposed to increase an area of the fit between the through hole 222 and the second one-way valve 2201. This improves the reliability of sealing between a wall of the through hole 222 and the outer circumferential surface of the second one-way valve 2201. In addition, structures of the first sealing portion 221 and the second sealing portion are simpler and can be processed more easily. This reduces processing costs of the sealing structure 220.

Optionally, the first sealing portion 221 is a tubular sealing ring.

Optionally, the annular sealing portion 223 is an annular sealing ring.

Optionally, the conical sealing portion 224 is a conical sealing ring.

In some embodiments, the first sealing portion 221, the annular sealing portion 223, and the conical sealing portion 224 are an integral structure. This improves tightness of the connection between the first sealing portion 221, the annular sealing portion 223, and the conical sealing portion 224 and improves the sealing reliability of the sealing structure 220.

In some embodiments, the sealing structure 220 is made of a sealing-type material to improve the sealing reliability of the sealing structure 220.

Optionally, the sealing-type material is silica gel.

A diameter of the conical sealing portion 224 gradually decreases in a direction from the blocking structure 230 to the bottom wall of the liquid inlet portion 2101. An outer circumferential surface of the conical sealing portion 224 is a first conical mating surface 2241. The blocking structure 230 includes a tubular body 231, a blocking plate 232, and a pushing post 233. An end surface of the tubular body 231 is close to the sealing structure 220, and a second conical mating surface 2311 is disposed on the end surface. An end of the tubular body 231 is away from the sealing structure 220, and the blocking plate 232 is disposed on the end to block the through hole 222. When the blocking structure 230 is in the blocking state, the tubular body 231 is sleeved on at least a part of the conical sealing portion 224, so that the first conical mating surface 2241 abuts against at least a part of the second conical mating surface 2311, and/or a plate surface of the blocking plate 232 faces the sealing structure 220, the pushing post 233 is disposed on the plate surface and configured to push a valve core of the second one-way valve 2201, and the pushing post 233 is coaxially disposed with the through hole 222. In this way, the first conical mating surface 2241 mates with the second conical mating surface 2311, so that an area of mating between the blocking structure 230 and the sealing structure 220 can be increased. This improves blocking reliability of the blocking structure 230 for the through hole 222. Based on the above disposition, the pushing post 233 pushes the valve core of the second one-way valve 2201, so that the second one-way valve 2201 is opened. In addition, the pushing post 233 coaxially disposed with the through hole 222 can be coaxially disposed with the second one-way valve 2201, so that pushing reliability of the pushing post 233 for the valve core of the second one-way valve 2201 is improved.

In some embodiments, in a process in which the second one-way valve 2201 pushes the blocking structure 230 to the open state and then continues to push the blocking structure 230 to enable the blocking structure 230 to abut against the bottom wall of the liquid inlet portion 2101, the pushing post 233 continuously pushes the valve core of the second one-way valve 2201, so that the second one-way valve 2201 is opened. In this way, the liquid in the storage cavity 113 can flow into the liquid inlet portion 2101 through the second one-way valve 2201.

In an embodiment, the tubular body 231 includes a second tubular structure 2312 and a third tubular structure 2313 connected to each other, and a second connection plate 2314. The third tubular structure 2313 is sleeved on the second tubular structure 2312 and is connected to the second tubular structure 2312 through the second connection plate 2314. The third tubular structure 2313 is disposed close to the sealing structure 220. A mounting space is enclosed by at least a part of an inner wall of the third tubular structure 2313, the second connection plate 2314, and at least a part of an outer circumferential surface of the second tubular structure 2312. The elastic structure is mounted in the mounting space. The second conical mating surface 2311 is disposed on an end of the third tubular structure 2313, and the end is close to the sealing structure 220. In this way, the mounting space is enclosed by the third tubular structure 2313, the second connection plate 2314, and the second tubular structure 2312, so that the elastic structure is mounted more stably and is prevented from falling off from the tubular body 231, and a resetting function of the elastic structure is not affected. This further improves the operation stability of the automatic underwater spreading assembly 320.

Specifically, the mounting space is a mounting groove.

Specifically, the elastic structure is sleeved on the second tubular structure 2312. An end of the elastic structure extends into the mounting groove and is limited and stopped by a groove wall of the mounting groove.

Specifically, the blocking structure 230 further includes a limitation plate 234 disposed on an outer circumferential surface of the third tubular structure 2313. In this way, the limitation plate 234 is limited and stopped by the inner wall of the liquid inlet portion 2101, so that a position of the tubular body 231 is limited. There are at least two limitation plates 234. The at least two limitation plates 234 are spaced from each other around the tubular body 231. In this way, a moving direction of the tubular body 231 is limited by the limitation plates 234, so that the tubular body 231 is prevented from deviating or shaking, and reliability of the contact between the second conical mating surface 2311 and the first conical mating surface 2241 is not affected. This further improves the blocking reliability of the blocking structure 230. In addition, a quantity of limitation plates 234 may be set more flexible and diverse to be applicable to various operating conditions and use requirements. This improves processing flexibility of a worker.

In some embodiments, there are at least twelve limitation plates 234. The twelve limitation plates 234 are spaced from each other around the tubular body 231.

It should be noted that a quantity of limitation plates 234 is not limited herein and may be adjusted based on an operating condition and a use requirement. Optionally, there may be two, three, four, five, six, or more limitation plates 234.

In some embodiments, an end surface of the limitation plate 234 is away from the sealing structure 220, and a guiding slope is disposed on the end surface. In this way, in a process in which the worker sleeves the elastic structure, the guiding slope can guide a moving direction of the elastic structure. This reduces difficulty in sleeving the elastic structure.

In some embodiments, a plate surface of the limitation plate 234 faces the second tubular structure 2312, and the plate surface is flush with an inner wall of the third tubular structure 2313 to avoid unevenness of a joint between the limitation plate 234 and the third tubular structure 2313. This improves sleeving smoothness of the elastic structure and reduces difficulty in sleeving the elastic structure.

In some embodiments, the automatic underwater spreading assembly 320 further includes a mounting structure 210. The mounting structure 210 is disposed between the storage module 110 and the sealing structure 220. The mounting structure 210 includes a tubular mounting portion 211 and a first connection plate 213 disposed on the tubular mounting portion 211. At least a part of the tubular mounting portion 211 is disposed in the liquid inlet portion 2101. The tubular mounting portion 211 includes a penetration hole 212 configured to allow the second one-way valve 2201 to pass through. The first connection plate 213 is configured to be connected to the storage module 110 and/or the body 190. In this way, the mounting structure 210 is disposed, so that the sealing structure 220 can be stably mounted in the liquid inlet portion 2101 to prevent the sealing structure 220 from shaking or deviating, and therefore, the blocking structure 230 can completely block the through hole 222. This improves the sealing reliability of the sealing structure 220 and the blocking reliability of the blocking structure 230.

In some embodiments, the penetration hole 212 communicates with and is coaxially disposed with the through hole 222. This can reduce difficulty in enabling the second one-way valve 2201 of the storage module 110 to pass through the through hole 222 and the penetration hole 212 and reduce disassembling difficulty and assembling difficulty.

In some embodiments, the first connection plate 213 is configured to be connected to the body 190. This reduces a quantity of components connected to the storage module 110. In this way, the worker can conveniently disassemble and assemble the storage module 110. This further reduces the disassembling difficulty and the assembling difficulty. In addition, because the first connection plate 213 is connected to the body 190, the first connection plate 213 can still be used to fix the tubular mounting portion 211 after the storage module 110 is detached. In some embodiments, the first sealing portion 221 is sleeved on the tubular mounting portion 211, and at least a part of the second sealing portion is located between the tubular mounting portion 211 and the stepped surface 2102. In this way, the first sealing portion 221 can seal a gap between an outer circumferential surface of the tubular mounting portion 211 and the inner wall of the liquid inlet portion 2101, and the second sealing portion can seal a gap between the stepped surface 2102 and a surface of the tubular mounting portion 211, where the surface faces the stepped surface 2102. In this way, the sealing structure 220 seals the gap between the tubular mounting portion 211 and the liquid inlet portion 2101 twice. This improves the sealing reliability of the sealing structure 220.

Specifically, although the sealing structure 220 can seal the gap between the outer circumferential surface of the tubular mounting portion 211 and the inner wall of the liquid inlet portion 2101 twice, the water in the pool may still flow into the sealing structure 220 through a gap between a wall of the penetration hole 212 and the outer circumferential surface of the second one-way valve 2201, and then flow into the liquid inlet portion 2101 through the gap between the wall of the through hole 222 and the outer circumferential surface of the second one-way valve 2201. The through hole 222 is in an interference fit with the second one-way valve 2201, so that the water in the pool can be blocked outside the sealing structure 220. This further improves the sealing reliability of the sealing structure 220.

Specifically, the worker only needs to sleeve the first sealing portion 221 on the tubular mounting portion 211, so that the sealing structure 220 can be assembled.

Specifically, if the through hole 222 is directly disposed on the annular sealing portion 223, the area of the fit between the wall of the through hole 222 and the outer circumferential surface of the second one-way valve 2201 depends on a thickness of the annular sealing portion 223, and the thickness of the annular sealing portion 223 depends on a gap distance between the tubular mounting portion 211 and the stepped surface 2102. In other words, based on the above disposition, the area of the fit between the wall of the through hole 222 and the outer circumferential surface of the second one-way valve 2201 may be small, affecting the reliability of sealing between the through hole 222 and the second one-way valve 2201. The conical sealing portion 224 is disposed, so that the area of the fit between the wall of the through hole 222 and the outer circumferential surface of the second one-way valve 2201 can be adjusted to ensure that the fit area is sufficiently large. This improves the reliability of sealing between the through hole 222 and the second one-way valve 2201.

In some embodiments, the tubular mounting portion 211 includes a first tubular structure 2111 and a plate structure 2112. The plate structure 2112 is disposed at an end of the first tubular structure 2111, and the end is close to the bottom wall of the liquid inlet portion 2101. The penetration hole 212 is disposed on the plate structure 2112. The first connection plate 213 is sleeved on the first tubular structure 2111. A fastener passes through the first connection plate 213 and the body 190 to connect the tubular mounting portion 211 to the body 190. The first sealing portion 221 is sleeved on the first tubular structure 2111. At least a part of the annular sealing portion 223 is disposed between the plate structure 2112 and the stepped surface 2102. In this way, the outer circumferential surface of the tubular mounting portion 211 can mate with the first sealing portion 221 to ensure that the first sealing portion 221 is in close contact with the inner wall of the liquid inlet portion 2101 and the outer circumferential surface of the first tubular structure 2111. This improves the sealing reliability of the first sealing portion 221. In addition, the annular sealing portion 223 can be in close contact with the stepped surface 2102 and the plate structure 2112. This improves the sealing reliability of the annular sealing portion 223.

Specifically, in a process of assembling the storage module 110, the second one-way valve 2201 passes through the penetration hole 212 and the through hole 222 sequentially and pushes the pushing post 233 of the blocking structure 230 in a passing process, so that the blocking structure 230 is pushed to move to the blocking state. When the blocking structure 230 abuts against the bottom wall of the liquid inlet portion 2101, the pushing post 233 pushes the valve core of the second one-way valve 2201. After the storage module 110 has been assembled, the pushing post 233 pushes the second one-way valve 2201 to the open state, and then the storage cavity 113 of the storage module 110 communicates with the liquid inlet portion 2101 of the body 190.

In some embodiments, the automatic underwater spreading assembly 320 may further include a stirring module 160.

The stirring module 160 is configured to stir the to-be-spread reagent that leaves the storage module 110, to evenly mix the reagent with liquid in space in which the reagent is located. The stirring module 160 may be disposed at various positions on the automatic underwater spreading assembly 320. For example, the to-be-spread reagent flows out from a side of the reagent outlet 193, and the stirring module 160 is disposed on the side. For another example, the stirring module 160 may be disposed in another space in which the to-be-spread reagent enters after leaving the storage module 110.

In some embodiments, the stirring module 160 may include a stirring member that performs stirring along a preset motion trajectory. For example, the stirring member may be a stirring rod or a rotating blade that performs stirring along the preset motion trajectory. The preset motion trajectory may be a preset stirring trajectory in which the stirring member evenly mixes the to-be-spread reagent with the liquid in the space in which the reagent is located. For example, the preset motion trajectory may be a spiral motion trajectory. In other words, the stirring member rotates along a spiral trajectory to form a strong vortex in the water body, so that the to-be-spread reagent and the liquid are evenly mixed. The preset motion trajectory may be other trajectories, such as an up-down motion trajectory. As shown in FIG. 3B, the stirring member may be an impeller 181 of a main water pump 180. The main water pump impeller 181 performs stirring along the preset motion trajectory, so that the to-be-spread reagent and the liquid in the space in which the reagent is located are mixed evenly. For more details about the main water pump 180, refer to the following description.

In some embodiments, the automatic underwater spreading assembly 320 may further include a cleaning module 170 and the main water pump 180.

The cleaning module 170 may be configured to cleaned liquid and/or a moving region of the automatic underwater spreading assembly 320. The cleaning module 170 may include one or more of a filtering box 171, a filtering mesh (not shown in the figure), a roller brush 172, or other components that can clean the liquid. The automatic underwater spreading assembly 320 may collect garbage or another debris on or under the water surface by using the filtering box 171. The filtering mesh may filter out and remove the garbage or another debris in the liquid. When the automatic underwater spreading assembly 320 moves on a bottom wall or a side wall of a region (such as a swimming pool) that accommodates the water, the roller brush 172 may further clean the bottom wall or the side wall. In some embodiments, the control module 150 may control the cleaning module 170 based on a third operating parameter. The third operating parameter may be an operating parameter of the cleaning module 170. The third operating parameter may include, but is not limited to, an open state and a closed state of the filtering box 171, a rotation frequency of the roller brush 172, and the like. Similar to the first operating parameter and the second operating parameter, the third operating parameter may be a preset default parameter or may be determined based on the parameter determining module. For details about determining the third operating parameter based on the parameter determining model, refer to FIG. 10 and related descriptions thereof.

The main water pump 180 may drive the external liquid to flow into the cleaning module 170 of the automatic underwater spreading assembly 320 through a liquid inlet 191 of the automatic underwater spreading assembly 320 and drive cleaned liquid in the cleaning module 170 to be spread in the water through a liquid outlet 192. As shown in FIG. 3A and FIG. 3B, the main water pump 180 may include the main water pump impeller 181 and a main water pump body 182. The main water pump body 182 may provide power for the main water pump impeller 181 to rotate. The main water pump impeller 181 may rotate under the power of the main water pump body 182 to provide a suction force to drive the liquid in the automatic underwater spreading assembly 320 to flow in a preset direction. In this way, the external liquid is driven to enter the automatic underwater spreading assembly 320 through a first liquid inlet 191-1 and a second liquid inlet 191-2 of the automatic underwater spreading assembly 320, and the cleaning module 170 may clean the liquid therein. The main water pump 180 may drive the liquid cleaned by the cleaning module 170 to be discharged through the liquid outlet 192.

In some embodiments, one end of the drive module 120 communicates with the outlet of the storage module 110, and the other end of the drive module 120 communicates with the reagent outlet 193. The main water pump 180 may further drive the cleaned liquid to flow through the reagent outlet 193 and drive the to-be-spread reagent flowing out through the reagent outlet 193 to be evenly mixed with the cleaned liquid and then spread in the water through the liquid outlet 192.

The automatic underwater spreading assembly 320 may include one or more liquid inlets 191 and liquid outlets 192. The liquid inlet 191 may be configured to allow the external liquid to enter the automatic underwater spreading assembly 320. The liquid outlet 192 may be configured to allow the liquid in the automatic underwater spreading assembly 320 to leave the automatic underwater spreading assembly 320. In some embodiments, when the automatic underwater spreading assembly 320 floats on the water surface and spreads the reagent, the automatic underwater spreading assembly 320 includes at least one liquid inlet 191 located under the water surface and the liquid outlet 192 to ensure that liquid can be sucked in through the liquid inlet 191 and can be discharged into the water body through the liquid inlet 191.

In some embodiments, the main water pump 180 may further provide a driving force for the automatic underwater spreading assembly 320 to move. As shown in FIG. 3A and FIG. 3B, the main water pump 180 may rotate to provide the suction force to drive the liquid in the automatic underwater spreading assembly 320 to flow in a preset direction. In this way, the external liquid is driven to enter the automatic underwater spreading assembly 320 through the first liquid inlet 191-1, the second liquid inlet 191-2, and a third liquid inlet 191-3 of the automatic underwater spreading assembly 320 and be discharged through the liquid outlet 192. When the liquid is discharged through the liquid outlet 192, a driving force in a direction opposite to a liquid discharging direction may be applied to the automatic underwater spreading assembly 320. For example, when the liquid outlet 192 is disposed on the bottom of the body 190 of the automatic underwater spreading assembly 320, and the main water pump 180 drives the liquid to be discharged through the liquid outlet 192, an upward driving force may be applied to the automatic underwater spreading assembly 320. When the driving force is greater than the gravity of the automatic underwater spreading assembly 320 and another downward resistance, the automatic underwater spreading assembly 320 may move upward.

In some embodiments of the present disclosure, the cleaning module 170 and the main water pump 180 are disposed, so that the automatic underwater spreading assembly 320 can perform both cleaning and reagent spreading. This shortens a maintenance period of the water body and reduces maintenance costs of the water body.

In some embodiments, driving modes of the drive module 120 may include a continuous driving mode and an intermittent driving mode.

When the drive module 120 is in the continuous driving mode, the drive module 120 may continuously drive the to-be-spread reagent to leave the storage module 110, and the corresponding first operating parameter may include the speed at which the to-be-spread reagent leaves the storage module 110. In this case, the automatic underwater spreading assembly 320 can continuously spread the reagent.

The driving mode of the drive module 120 may be preset by the user or determined by the control module 150. For details about determining the driving mode of the drive module 120 by the control module 150, refer to FIG. 10 and related descriptions thereof.

In some embodiments, the automatic underwater spreading assembly 320 may further include a working mode selection module (not shown in the figure). The working mode selection module may be configured to adjust a working mode of the automatic underwater spreading assembly 320. The working modes may include a spreading mode and a cleaning mode. The spreading mode may be a mode in which the to-be-spread reagent is spread from the automatic underwater spreading assembly 320 in the water body. The cleaning mode may be a mode in which garbage or another debris is cleaned and removed from the water body. That the automatic underwater spreading assembly 320 operates may mean that the automatic underwater spreading assembly 320 is in one working mode or in two working modes at the same time.

In some embodiments, the working mode selection module may include a spreading selection unit. The spreading selection unit may be configured to adjust a driving mode of the automatic underwater spreading assembly 320 in the spreading mode. The driving modes of the automatic underwater spreading assembly 320 in the spreading mode may include the continuous driving mode and the intermittent driving mode. For more details about the continuous driving mode and the intermittent driving mode, refer to the above description. The spreading selection unit may control the driving mode of the drive module 120, so that the drive module 120 can be switched between the continuous driving mode and the intermittent driving mode.

In some embodiments, the moving module 140 may be further configured to adjust an operation mode of the automatic underwater spreading assembly 320. The operation modes of the automatic underwater spreading assembly 320 may include a water surface operation mode and an underwater operation mode. The water surface operation mode may indicate that the automatic underwater spreading assembly 320 floats and operates on the water surface. The underwater operation mode may indicate that the automatic underwater spreading assembly 320 submerges and operates in the water. The moving module 140 may include a buoyancy cavity and/or a propeller in a vertical direction. The buoyancy cavity and/or the propeller in the vertical direction may provide an action force in the vertical direction for the automatic underwater spreading assembly 320, so that the automatic underwater spreading assembly 320 can be switched between a position on the water surface and a position under the water surface.

In some embodiments of the present disclosure, various working modes and operation modes of the automatic underwater spreading assembly 320 are set, so that the automatic underwater spreading assembly 320 can perform water surface spreading, underwater spreading, water surface cleaning, and underwater cleaning. Further, the driving mode of the automatic underwater spreading assembly 320 may be adjusted when the automatic underwater spreading assembly 320 performs spreading. In this way, the user can select various modes based on requirements. This improves selection diversity of the user, enriches a manner in which the automatic underwater spreading assembly 320 can pertinently spread the reagent and/or clean the water body, and improves user experience.

In some embodiments, the automatic underwater spreading assembly 320 further includes a reagent dose detection module 101. The reagent dose detection module 101 is configured to detect an in-position state of the storage module 110 and/or a quantity of to-be-spread reagents stored in the storage module 110.

Specifically, the in-position state of the storage module 110 is a state indicating whether the storage module 110 is mounted on the automatic underwater spreading assembly 320. When the storage module 110 is mounted on the automatic underwater spreading assembly 320, the storage module 110 is in the in-position state. When the storage module 110 is not mounted on the automatic underwater spreading assembly 320, the storage module 110 is not in the in-position state. The reagent dose detection module 101 may be configured to detect only the in-position state of the storage module 110. The reagent dose detection module 101 may alternatively be configured to detect only the quantity of to-be-spread reagents stored in the storage module 110. The reagent dose detection module 101 may alternatively be configured to detect both the in-position state of the storage module 110 and the quantity of to-be-spread reagents stored in the storage module 110.

Based on the above disposition, the automatic underwater spreading assembly 320 detects in time, by using the reagent dose detection module 101, whether the quantity of to-be-spread reagents meets a spreading requirement, so that the user can replenish the to-be-spread reagent in time, and the automatic underwater spreading assembly 320 is used conveniently.

Compared with the conventional technology, this embodiment provides the automatic underwater spreading assembly 320 including the storage module 110, the drive module 120, the reagent outlet 193, and the control module 150. The storage module 110 is configured to store the to-be-spread reagent. The drive module 120 is connected to the storage module 110. The drive module 120 is configured to drive the to-be-spread reagent to leave the storage module 110, and/or to adjust the flow rate at which the to-be-spread reagent leaves the storage module 110. The reagent outlet 193 serves as an outlet for the to-be-spread reagent to leave the storage module 110 and then enter the liquid. The control module 150 is connected to the drive module 120 and the moving module 140 via signals and configured to control the drive module 120. Based on the above disposition, the automatic underwater spreading assembly 320 can automatically spread the reagent in the water in the pool without manual operation. This facilitates and simplifies water quality maintenance, shortens a maintenance period of the pool, and reduces maintenance costs.

With reference to FIG. 22 and FIG. 23, the present disclosure provides a pool cleaning system 300. The pool cleaning system 300 may be configured to clean a pool. The pool cleaning system 300 includes a pool robot 100 and a pool control assembly 310. The pool control assembly 310 is disposed in the pool. The pool control assembly 310 is configured to allow water in the pool to circulate and/or serves as a related mating structure of the pool robot 100. The automatic underwater spreading assembly 320 is disposed on the pool robot 100 and/or the pool control assembly 310. A water quality detection module 330 is disposed on at least one of the pool robot 100 or the pool control assembly 310. The water quality detection module 330 is configured to obtain water quality data of each region of the pool. The water quality data may include a pH value, turbidity, a quantity of total solids, salinity, and the like of the water in the pool. The water quality detection module 330 is connected to a control module 150 via signals. The water quality data may be transmitted to the control module 150.

Based on the above disposition, the pool cleaning system 300 detects water quality by using the water quality detection module 330 and cleans water by using the automatic underwater spreading assembly 320, so that the water quality of the pool can be well monitored and maintained in a better state without manually spreading the reagent. This facilitates and simplifies water quality maintenance, shortens a maintenance period of the pool, and reduces maintenance costs.

Disposition and distribution of the automatic underwater spreading assembly 320 and the water quality detection module 330 may be determined based on an actual situation. For example, the automatic underwater spreading assembly 320 may be disposed only on the pool robot 100. The automatic underwater spreading assembly 320 may alternatively be disposed only on the pool control assembly 310. The automatic underwater spreading assembly 320 may alternatively be disposed on both the pool robot 100 and the pool control assembly 310.

The water quality detection module 330 may be disposed only on the pool robot 100. The water quality detection module 330 may alternatively be disposed only on the pool control assembly 310. The water quality detection module 330 may alternatively be disposed on both the pool robot 100 and the pool control assembly 310.

The automatic underwater spreading assembly 320 and the water quality detection module 330 are flexibly disposed, so that the user can flexibly configure the pool cleaning system 300. For example, the automatic underwater spreading assembly 320 may be disposed only on the pool robot 100, and the water quality detection module 330 may be disposed on the pool control assembly 310. In this way, the water quality of the pool can be detected by the pool control assembly 310, and the pool robot 100 does not need to move frequently to reach a detection position. This increases a battery life of the pool robot 100. For another example, the water quality detection module 330 may be disposed on the pool robot 100, and the automatic underwater spreading assembly 320 may be disposed on the pool control assembly 310. In this way, water quality of each region of the pool can be detected more comprehensively based on a moving capability of the pool robot 100. In addition, because the automatic underwater spreading assembly 320 is disposed on the pool control assembly 310, a weight of the pool robot 100 can be reduced.

In some embodiments, the pool control assembly 310 includes a station 311. The station 311 may provide charging, signal relaying, cleaning, maintenance, and other functions for the pool robot 100. The station 311 is disposed at a poolside or floats on the water surface of the pool. The pool control assembly 310 and/or the water quality detection module 330 are/is disposed on the station 311. In this way, the pool robot 100 can cooperate with the station 311 to complete water quality detection and maintenance for the pool, and the liquid can be cleaned well.

In some embodiments, the pool control assembly 310 includes a water circulation system 312. The water circulation system 312 is configured to add liquid to the pool. The automatic underwater spreading assembly 320 is disposed in the water circulation system 312. The water circulation system 312 further includes a discharging opening 3121. The liquid enters the pool through the discharging opening 3121. The discharging opening 3121 communicates with a reagent outlet 193 in an open-close manner. When the reagent outlet 193 communicates with the discharging opening 3121, the liquid is evenly mixed with a to-be-spread reagent. When the reagent outlet 193 is closed, the reagent outlet 193 does not communicate with the discharging opening 3121, and the to-be-spread reagent does not enter the liquid.

Opening and closing of the reagent outlet 193 may be controlled by the control module 150. The reagent outlet 193 may be opened when the water quality detection module 330 detects poor water quality, so that the to-be-spread reagent enters the pool to purify the liquid in the pool. The reagent outlet 193 may be closed when the water quality detection module 330 detects good water quality, so that only the liquid is added to the pool through the discharging opening 3121.

In this way, the pool cleaning system 300 can directly spread the to-be-spread reagent in the liquid in the pool during water circulation, leading to a simple structure. In addition, the to-be-spread reagent can be mixed with the liquid and evenly distributed to each region of the pool as the liquid flows, so that the pool cleaning system 300 can clean the liquid more evenly, and cleaning blind corners may not be easily formed.

In some embodiments of the present disclosure, the pool robot 100 can automatically maintain the water quality. This enriches functions of the pool robot 100, reduces manual maintenance costs, and shortens the maintenance period of the target water body.

The terms "first", "second", "third", and the like in the present disclosure are merely intended for a purpose of description, and shall not be understood as an indication of a quantity of indicated technical features. Therefore, a feature limited by "first", "second", or "third" may explicitly or implicitly include at least one of the features. All directional indications (for example, up, down, left, right, front, rear . . . ) in embodiments of the present disclosure are merely intended for explaining a relative position relationship, movement, and the like of components in a specific posture (as shown in the accompanying drawings), and the directional indications correspondingly change if the particular posture changes. In addition, the terms "include", "have", and any variants thereof are intended to cover non-exclusive inclusion. For example, a process, a method, a system, a product, or a device that includes a series of steps or units is not limited to the listed steps or units, but optionally further includes an unlisted step or unit, or optionally further includes another inherent step or unit of the process, the method, the product, or the device.

The above description describes only embodiments of the present disclosure and is not intended to limit the scope of the present disclosure. Any equivalent structure or equivalent process transformation performed based on the contents of this specification and the accompanying drawings of the present disclosure or applied directly or indirectly in other related technical fields shall fall within the protection scope of the present disclosure.

What is claimed is:

1. A pool robot, comprising:

a body comprising a liquid inlet portion;

a storage module configured to store a to-be-spread reagent, wherein the storage module is detachably disposed on the body, wherein the storage module comprises a storage cavity and a one-way valve communicating with the storage cavity, wherein when the storage module is disposed on the body, at least a part of the one-way valve extends into the liquid inlet portion, enabling liquid in the storage cavity to flow into the liquid inlet portion;

a drive module disposed on the body and connected to the storage module, wherein the drive module is configured to drive the to-be-spread reagent to leave the storage module;

a moving module disposed on the body, wherein the moving module is configured to drive the pool robot to move in water along a motion path;

a control module disposed on the body and connected to the drive module and the moving module via signals, wherein the control module is configured to control the drive module and the moving module; and a sealing structure, wherein at least a part of the sealing structure is disposed in the liquid inlet portion to seal a joint between the one-way valve and the liquid inlet portion.

2. The pool robot according to claim 1, wherein:

the sealing structure comprises a through hole configured to allow the one-way valve to pass through; and the pool robot further comprises a blocking structure, wherein at least a part of the blocking structure is movably disposed in the liquid inlet portion, wherein when the storage module is detached from the body, the blocking structure is switched to a blocking state to block the through hole, and when the storage module is assembled on the body, the blocking structure is switched to an open state to avoid at least a part of the through hole, enabling the one-way valve to communicate with the liquid inlet portion.

3. The pool robot according to claim 2, further comprising an elastic structure, wherein one end of the elastic structure is connected to the blocking structure and the other end of the elastic structure is connected to a bottom wall of the liquid inlet portion, wherein when the storage module is detached from the body, the blocking structure is reset to the blocking state under an elastic force of the elastic structure.

4. The pool robot according to claim 2, wherein when the blocking structure is in the open state, a flow gap is formed between at least a part of the blocking structure and the sealing structure, wherein the one-way valve communicates with the liquid inlet portion through the flow gap.

5. The pool robot according to claim 2, wherein the blocking structure comprises a tubular body, a blocking plate, and a pushing post, wherein the pushing post is disposed on a plate surface of the blocking plate and configured to push a valve core of the one- way valve, wherein the plate surface of the blocking plate faces the sealing structure and the pushing post is coaxially disposed with the through hole.

6. The pool robot according to claim 2, wherein a stepped surface is disposed in the liquid inlet portion, wherein the sealing structure comprises a first sealing portion and a second sealing portion connected to each other, wherein the second sealing portion is disposed on the stepped surface, the second sealing portion comprises the through hole, and the first sealing portion is located on a side of the second sealing portion, wherein the side of the second sealing portion is away from the stepped surface.

7. The pool robot according to claim 6, wherein the first sealing portion is tubular and the second sealing portion comprises an annular sealing portion and a conical sealing portion, wherein the annular sealing portion is connected to the first sealing portion, the conical sealing portion is connected to the annular sealing portion, and the conical sealing portion is disposed at an inner hole of the annular sealing portion and located at a side of the annular sealing portion, wherein the side of the annular sealing portion is away from the first sealing portion and an end of the conical sealing portion is away from the annular sealing portion, wherein the end of the conical sealing portion is the through hole.

8. The pool robot according to claim 2, further comprising a mounting structure, wherein the mounting structure is disposed between the storage module and the sealing structure, wherein the mounting structure comprises a tubular mounting portion and a first connection plate disposed on the tubular mounting portion, wherein at least a part of the tubular mounting portion is disposed in the liquid inlet portion, the tubular mounting portion comprises a penetration hole configured to allow the one-way valve to pass through, and the first connection plate is configured to be connected to the storage module and/or the body.

9. The pool robot according to claim 8, wherein in a process of assembling the storage module on the body, the one-way valve passes through the penetration hole and the through hole sequentially and pushes the pushing post of the blocking structure in a passing process, so that the blocking structure is pushed to move to the blocking state, wherein when the blocking structure abuts against a bottom wall of the liquid inlet portion, the pushing post pushes a valve core of the one-way valve, wherein after the storage module has been assembled, the pushing post pushes the one-way valve to an open state, and then the storage cavity of the storage module communicates with the liquid inlet portion of the body.

10. The pool robot according to claim 1, wherein the storage module comprises a storage cavity, wherein a second opening is disposed on the storage cavity and configured to allow fluid to enter the storage cavity.

11. The pool robot according to claim 10, wherein:

a first one-way valve is disposed in the second opening, wherein the first one-way valve is configured to allow the fluid to unidirectionally flow in a direction in which the fluid enters the storage cavity; or the storage cavity further comprises a sealing cover detachably covering the second opening; or a first one-way valve is disposed in the second opening and a sealing cover is detachably disposed at the second opening and covers the first one-way valve.

12. A pool robot, comprising:

a body:

a storage module configured to store a to-be-spread reagent, wherein the storage module is detachably disposed on the body;

a moving module disposed on the body, wherein the moving module is configured to drive the pool robot to move in water along a motion path;

a reagent outlet disposed on the body;

a drive module disposed on the body and connected to the storage module, wherein the drive module is configured to drive the to-be-spread reagent to leave the storage module, wherein:

the drive module comprises a first drive pump, wherein one end of the first drive pump communicates with an outlet of the storage module and the other end of the first drive pump communicates with the reagent outlet; and the first drive pump has a first operating state and a second operating state, wherein when the first drive pump is in the first operating state, the first drive pump generates a driving force in a direction from the storage module to the reagent outlet, and when the first drive pump is in the second operating state, the first drive pump generates a driving force in a direction from the reagent outlet to the storage module; and a control module disposed on the body and connected to the drive module and the moving module via signals, wherein the control module is configured to control the drive module and the moving module.

13. The pool robot according to claim 12, wherein when the first drive pump is in the first operating state, the first drive pump drives the to-be-spread reagent to leave the storage module, and the first drive pump is switched to the second operating state after the reagent has been spread, enabling a residual reagent between the reagent outlet and the storage module to be pumped out and discharged.

14. A pool robot, comprising:

a body;

a storage module configured to store a to-be-spread reagent, wherein the storage module is detachably disposed on the body;

a drive module disposed on the body and connected to the storage module, wherein the drive module is configured to drive the to-be-spread reagent to leave the storage module, wherein the drive module comprises an adjustment assembly, wherein the adjustment assembly comprises:

a spreading duct communicating with an outlet of the storage module; and a flow rate adjustment part configured to change a flow rate of fluid in the spreading duct, wherein the flow rate adjustment part is capable of moving relative to the spreading duct between a first position and a second position, wherein in a process in which the flow rate adjustment part moves from the first position to the second position, the flow rate adjustment part is in contact with and squeezes the spreading duct, enabling a cross-sectional area of the spreading duct to be changed;

a moving module disposed on the body, wherein the moving module is configured to drive the pool robot to move in water along a motion path; and a control module disposed on the body and connected to the drive module and the moving module via signals, wherein the control module is configured to control the drive module and the moving module.

15. The pool robot according to claim 10, wherein the drive module further comprises a position-limiting groove disposed on a side of the spreading duct, wherein a shortest distance from the position-limiting groove to an axis of the spreading duct gradually increases or decreases in an axial direction of the spreading duct; and the flow rate adjustment part is slidably disposed in the position-limiting groove, wherein the flow rate adjustment part slides between the first position and the second position along the position-limiting groove.

16. The pool robot according to claim 1, further comprising a reagent dose detection module configured to detect an in-position state of the storage module and/or a quantity of to-be-spread reagents stored in the storage module.

17. The pool robot according to claim 1, further comprising a water quality detection module configured to obtain water quality data of a pool, wherein the water quality detection module is connected to the control module via signals and the drive module controls the to-be-spread reagent to be spread based on detection data of the water quality detection module.

* * * * *